US010010998B2

(12) United States Patent
Kaga et al.

(10) Patent No.: US 10,010,998 B2
(45) Date of Patent: Jul. 3, 2018

(54) SHOT PROCESSING APPARATUS

(71) Applicant: SINTOKOGIO, LTD., Nagoya-shi, Aichi (JP)

(72) Inventors: Hideaki Kaga, Toyokawa (JP); Hiroaki Suzuki, Toyokawa (JP); Shoichi Yamamoto, Toyokawa (JP); Masato Umeoka, Toyokawa (JP); Takuya Koyama, Toyokawa (JP)

(73) Assignee: SINTOKOGIO, LTD., Aichi (JP)

( * ) Notice: Subject to any disclaimer, the term of this patent is extended or adjusted under 35 U.S.C. 154(b) by 109 days.

(21) Appl. No.: 15/142,688

(22) Filed: Apr. 29, 2016

(65) Prior Publication Data

US 2016/0318153 A1 Nov. 3, 2016

Related U.S. Application Data

(63) Continuation of application No. PCT/JP2015/068322, filed on Jun. 25, 2015.

(30) Foreign Application Priority Data

Jul. 15, 2014 (JP) ..... 2014-145181

(51) Int. Cl.
*B24C 3/08* (2006.01)
*B24C 3/14* (2006.01)
(Continued)

(52) U.S. Cl.
CPC ..... *B24C 1/10* (2013.01); *B24C 3/08* (2013.01); *B24C 3/085* (2013.01); *B24C 3/14* (2013.01); *B24C 5/06* (2013.01)

(58) Field of Classification Search
CPC ..... B24C 3/08; B24C 3/085; B24C 3/086; B24C 3/14; B24C 3/26; B24C 3/30; B24C 5/06
(Continued)

(56) References Cited

U.S. PATENT DOCUMENTS 2,108,210 A * 2/1938 Rosenberger ..... B24C 3/30 451/102
2,116,160 A * 5/1938 Rosenberger ..... B24C 3/30 451/2
(Continued)

FOREIGN PATENT DOCUMENTS

CN 202200184 U 4/2012
JP S 52-166898 U 12/1977
(Continued)

OTHER PUBLICATIONS

International Search Report, and English language translation thereof, in corresponding International Application No. PCT/JP2015/068322, dated Sep. 15, 2015, 6 pages.

*Primary Examiner* — Eileen Morgan
(74) *Attorney, Agent, or Firm* — Brinks Gilson & Lione

(57) ABSTRACT

The purpose of the present invention is to provide a shot peening apparatus for which size increase is limited by projecting a shot material evenly on a workpiece using a single projector. The present invention provides a shot peening apparatus equipped with a workpiece-conveying mechanism for conveying a workpiece and a projector for projecting a shot material at the workpiece. The workpiece-conveying mechanism is equipped with: a pair of rollers, which extend in the workpiece conveyance direction, on which the workpieces are loaded, and which are rotated centered on the longitudinal axis line; an endless chain; and conveyance members for pressing and conveying workpieces in the conveyance direction. The projector is a centrifugal projector and is equipped with: a control cage into which the shot material is supplied and in which a first opening and a second opening are formed; and a bladed wheel, which is provided with multiple blades having a backward-sloping section that slopes toward the back in the rotation direction and which rotates centered on the central
(Continued)

axis line of the control cage. The first opening and the second opening of the control cage are separated from each other in the circumferential direction of the control cage and are disposed offset from each other in the direction of the central axis line of the control cage.

4 Claims, 22 Drawing Sheets

(51) Int. Cl.
*B24C 5/06* (2006.01)
*B24C 1/10* (2006.01)

(58) Field of Classification Search
USPC ..... 451/35, 83, 95, 97
See application file for complete search history.

(56) References Cited

U.S. PATENT DOCUMENTS 2,131,767 A * 10/1938 Turnbull ..... B24C 3/085 451/81
2,132,311 A * 10/1938 Minich ..... B24C 3/14 451/80
2,204,634 A * 6/1940 Turnbull ..... B24C 5/062 451/98
2,224,647 A * 12/1940 Karl ..... B24C 3/04 451/95
2,440,819 A * 5/1948 Evans ..... B24C 3/30 451/3
2,449,745 A * 9/1948 Jewell ..... B24C 3/30 451/86
2,732,666 A * 1/1956 Powell ..... B24C 5/06 451/94
3,653,239 A * 4/1972 Carpenter, Jr. ..... B24C 5/068 72/53
3,683,556 A * 8/1972 Leliaert ..... B24C 5/062 451/97
3,694,963 A * 10/1972 Leliaert ..... B24C 5/062 451/97
3,841,025 A * 10/1974 Maeda ..... B24C 5/068 451/95
4,034,516 A * 7/1977 Maeda ..... B24C 5/06 241/275
4,277,965 A * 7/1981 Rutten ..... B24C 5/062 451/98
4,366,690 A * 1/1983 Rutten ..... B24C 5/062 72/53
2013/0017767 A1 * 1/2013 Suzuki ..... B24C 3/085 451/86
2015/0290770 A1 10/2015 Ishikawa et al.

FOREIGN PATENT DOCUMENTS

JP 54-89391 A 7/1979
JP S 60-157166 U 10/1985
JP S60-157167 U 10/1985
JP S 64-71666 A 3/1989
JP 2001-71219 A 3/2001
WO WO 2013/186939 A1 12/2013

* cited by examiner

R 1
O 1
L 1
L 2
L 4
L 5
L 8
P 1
θ 1
B 1
310
311
311a
311c
311d
312
317
303
303b
303c
303d
303e
303f
303g
303j
303n
303p
303p、303s
303q
303r
303s
303t
303u 307
307h
307g
307g
D1
D2
307h 307
307h1
307c
307k
307m
307a
307h2
307g1
307b
307k
307p
307h
S3
D1
L9
S3
307h1
307k
307g1
307m
307h2
307k
307h
307g 307p
307h1
307h
307h2
307u
307g
D1
307a
307h1
307h2
307h
307

307
307i
307k
307m
307h
307h3
307j
307k 307k
307m
307k
307p
307q
D1
307g
307k
307a
307m
307k
307u
307

D2
307
307n
307h
307c
307d
307b
307p
307g
307q
307h3
307j
307u

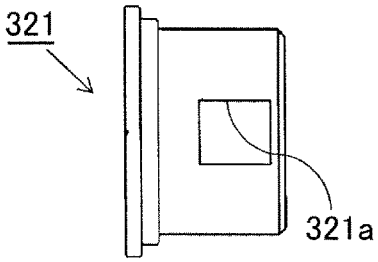
FIG.22A
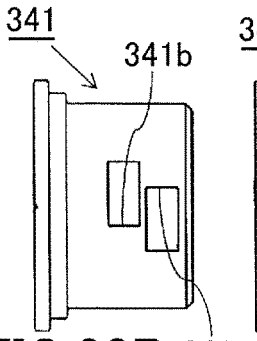
FIG.22B
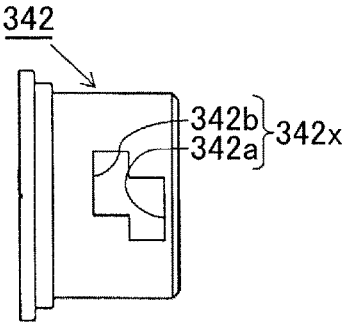
FIG.22C
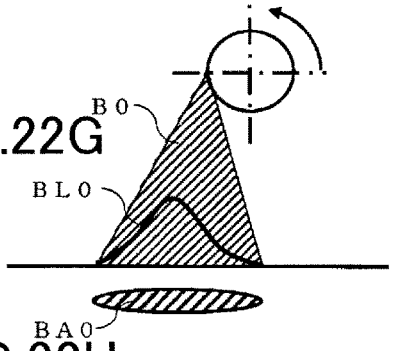
FIG.22G
FIG.22H
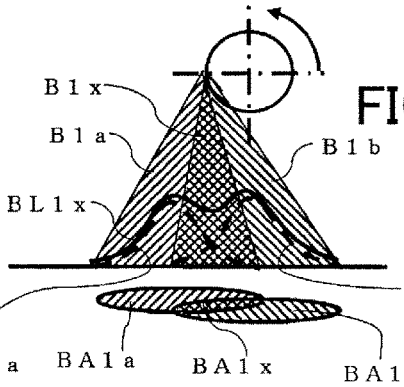
FIG.22I
FIG.22J
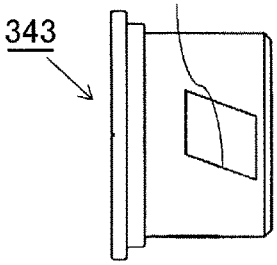
FIG.22D
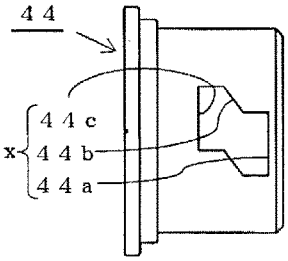
FIG.22E
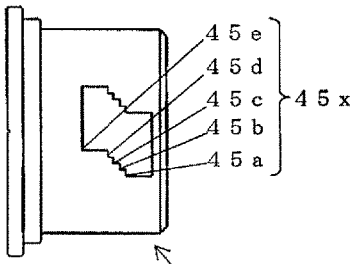
FIG.22F
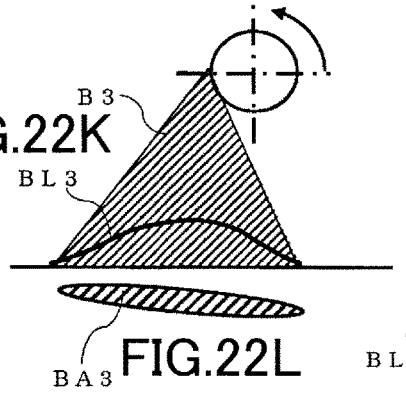
FIG.22K
FIG.22L
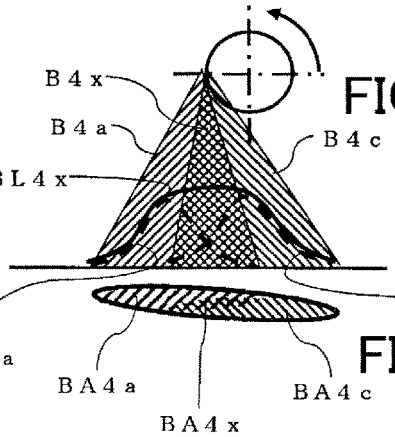
FIG.22M
FIG.22N

SHOT PROCESSING APPARATUS

RELATED APPLICATIONS

The present application is a continuation of International Application PCT/JP2015/068322, with an international filing date of Jun. 25, 2015, which claims priority to Japanese Patent Application No. 2014-145181 filed on Jul. 15, 2014, the entire contents of which are incorporated herein by reference.

TECHNICAL FIELD

The present invention relates to a shot processing apparatus, and more particularly to a shot processing apparatus for projecting projection material onto a processing target (workpiece) to treat the workpiece surface.

BACKGROUND ART

There are known shot processing apparatuses for treating the surface of a coil spring workpiece by projecting projection material (see, for example, Patent Document 1).

In such apparatuses, in order to thoroughly project projection material over the entire circumference of a spring wire forming a coil spring, a coil spring is transported inside a blast cleaning chamber while being rotated about its longitudinal axis, and projection material is projected onto the coil spring using two centrifugal projectors. The two centrifugal projectors are arranged so that their respective blade wheels rotate in opposite directions, and so as to have differing peak projection angles in their projection distributions.

PRIOR ART REFERENCES

Patent Documents

Patent Document 1: Japanese Unexamined Patent Publication No. 2001-71219.

SUMMARY OF THE INVENTION

Problems to be Solved by the Invention

The problem arose, however that two projectors are required in the shot processing apparatus of the Patent Document 1, the shot processing apparatus as a whole increases in size.

The present invention was undertaken to resolve these problems, and has the object of providing a shot processing apparatus constrained from increasing in size by projecting projection material onto a workpiece thoroughly using a single projector.

Means for Resolving Problems

The present invention provides a shot processing apparatus, comprising: a workpiece transport mechanism for transporting a workpiece, and a projector for projecting projection material onto the workpiece; wherein the workpiece transport mechanism comprises: a pair of rollers disposed in parallel so as to extend in the direction of workpiece transport, loading the workpiece thereon and rotationally driven about the longitudinal axis thereof; an endless chain rotationally driven in the direction of workpiece transport; and a transport member, attached to the endless chain so as to project outward between the pair of rollers, for pushing forward and transporting a workpiece loaded onto the pair of rollers by rotationally driving the endless chain; wherein the projector is a centrifugal projector, disposed above the pair of rollers, for projecting projection material onto a workpiece loaded onto the pair of rollers, comprising: a control cage, having a cylindrical shape and disposed so that its central axis extends in a direction perpendicular to the workpiece transport direction, into which projection material is supplied, and on the side walls of which a first opening and a second opening, serving as discharge ports for the projection material, are formed; and a blade wheel comprising multiple blades disposed outside the control cage to extend in the radially outward direction of the control cage, rotating about the central axis of the control cage, wherein on the blades, a rearward inclining portion sloping to the rearward side in the rotational direction is provided on the surface of the front side in the rotational direction; and the first opening and the second opening on the control cage are mutually separated in the circumferential direction of the control cage and are disposed at an offset on the central axis of the control cage.

In the invention thus constituted, when the endless chain is rotationally driven the transport member attached to the endless chain pushes and transports the workpiece loaded onto the pair of rollers in transport direction. Since the pair of rollers is rotationally driven about the longitudinal axis, while it is being transported by the transport member, the workpiece loaded on the pair of rollers is rotated (self-rotates) by the rollers together with the rotation of the rollers. As a result, projection material projected from the projector is thoroughly projected onto the outer perimeter side of the workpiece, and uniform shot processing is achieved.

In the projector, the blades of the blade wheel disposed on the outer perimeter side of the control cage rotate in the control cage perimeter direction, therefore projection material discharged through the first opening and the second opening in the control cage is accelerated by the blades and projected onto the workpiece. Projection material thus accelerated and projected by the rotation of the blade wheel is somewhat diffused as it is projected.

In the constitution above, the blade wheel rotates about the central axis of the control cage disposed so as to face in a direction perpendicular to the workpiece transport direction, therefore projection material projected by the rotation of the blade wheel is projected so as to diffuse in the workpiece transport direction.

Here a rearward inclining portion, sloping to the rear side in the rotational direction relative to the radial direction of the blade wheel, is formed on the surface of the blades in the blade wheel of the present invention. Hence projection material discharged later from the control cage contacts the blade surfaces and is accelerated toward the blade tip side before projection material first discharged from the control cage contacts blade surfaces. This means that at the point in time when the first discharged projection material contacts the blade surface, subsequently-discharged projection material and earlier-discharged projection material are gathered at a position close to the blade surface. As a result, the dispersion width of the projection material projection is constrained and concentrated along the workpiece transport direction.

The control cage comprises a first opening and second opening as projection material discharge openings; the first opening and the second opening are mutually separated in the circumferential direction, and are offset in the central axis direction of the control cage. Projection material respectively discharged from the first opening and the second opening is thus respectively discharged from positions separated in the circumferential direction of the control cage, and is projected at an offset in the workpiece transport direction, with the dispersion widths of the respective projection material streams constrained.

Hence the overall projection distribution becomes a distribution in which two projection distributions with constrained dispersion widths are combined, having two projection peaks in the effective projection range of the projector. Therefore the workpiece can be shot processed with good balance from the diagonally upward side on the downstream side of the transport direction and from diagonally upward side on the upstream side of the transport direction, using a single projector.

The first opening and the second opening have a rectangular shape in which two sides are parallel to the central axis of the control cage.

By this configuration, projection material can be projected in a concentrated manner onto the workpiece.

In another preferred embodiment of the invention, the blade comprises, at the tip side of the rearward inclining portion, a non-rearward inclining portion with a inclining angle smaller on the rotational direction side than the rearward inclining portion.

In the invention thus constituted, a rearward inclining portion is formed on the base end side of the blade, and a non-rearward inclining portion is formed on the tip portion side of the blade surface, therefore projection material concentrated at the rearward inclining portion is accelerated and projected by the non-rearward inclining portion.

Note that in this Specification, "inclining angle toward the rear side in the rotational direction is smaller than on the rearward inclining portion" covers configurations in which the inclining angle extends in the radial direction, and in which it inclines to the front side in the rotational direction, as well as configurations in which the inclining angle is smaller than the inclining angle toward the rear side in the rotational direction of the rearward inclining portion.

In another preferred embodiment of the invention, the radial length of the rearward inclining portion is set to be longer than the radial length of the non-rearward inclining portion.

In this constitution, the velocity of projection material can be increased at the non-rearward inclining portion after sufficient projection material is gathered at the rearward inclining portion of the blade.

In another preferred embodiment of the invention, the rearward inclining portion and the non-rearward inclining portion are connected by a curving portion.

By this constitution, after gathering projection material at the rearward inclining portion of the blade, the projection material velocity can be gradually increased using the curved portion and the non-rearward inclining portion thereof.

The present invention also provides a shot processing apparatus, comprising a workpiece transport mechanism for transporting a workpiece, and a projector for projecting projection material onto the workpiece; wherein the workpiece transport mechanism comprises: a pair of rollers disposed in parallel so as to extend in a direction of workpiece transport, loading the workpiece thereon and rotationally driven about the longitudinal axis thereof; an endless chain rotationally driven in the direction of workpiece transport; and a transport member, attached to the endless chain so as to project outwardly between the pair of rollers, for pushing forward and transporting a workpiece loaded onto the pair of rollers by rotationally driving the endless chain; wherein the projector is a centrifugal projector, disposed above the pair of rollers, for projecting the projection material onto the workpiece loaded onto the pair of rollers, comprising: a control cage, having a cylindrical shape and disposed so that its central axis extends in a direction perpendicular to the workpiece transport direction, into which the projection material is supplied, and on the side walls of which a first opening and second opening, serving as discharge ports for the projection material, are formed; and a blade wheel, wherein the blade wheel includes at least one side plate; a plurality of blades attached to the side plate so as to extend radially outwardly of the control cage outside of the control cage; a rotary shaft for rotating the side plate and the plurality of blades; and an introducing part for introducing the projection material between the plurality of blades; wherein the blade includes a projection surface for projecting the projection material, and the projection surface has a first part being a radially inner part of the blade and a second part being a radially outer part of the blade; the first part of the blade is formed so as to be inclined such that a radially outer side of the first part is rearwardly positioned in a rotational direction compared to a radially inner side of the first part, and the second part of the blade is formed to be positioned frontwardly of an imaginary line in the rotational direction, which imaginary line is defined by extending the first part of the blade in the radially outward direction, wherein the blade has a blade projection portion on which the projection surface for projecting the projection material is formed, and an attachment portion being formed thicker than the blade projection portion at both edge portions of the blade projection portion and integrally formed with the blade projection portion; wherein the attachment portion is formed in a straight shape at least in a plane perpendicular to the rotary shaft direction of the blade in its outer part and has a locking portion formed such that a plane perpendicular to the direction of the rotary shaft in the radial inner part thereof is formed so as to project from the straight shape; a side plate unit for attaching the plurality of blades thereto; wherein the side plate unit includes a pair of side plates having at least the one side plate, and a connecting member for connecting the pair of side plates; guide channel portions are respectively formed on mutually opposing surfaces of the pair of the side plates in the side plate unit; and the side plate guide channel portions are formed to be inclined such that the radial outer side thereof is positioned rearwardly of the radial inner side thereof in the rotational direction; wherein the side plate unit is attached to the rotary shaft by a bolt, and a recessed portion for attaching the bolt is provided in the guide channel portion of the side plate of the side plate unit; and wherein the first opening and the second opening on the control cage are mutually separated in the circumferential direction of the control cage and are disposed at an offset on the center line of the control cage.

In another preferred embodiment of the invention, the first opening and the second opening have a rectangular shape in which two sides thereof are parallel to the center line of the control cage.

In another preferred embodiment of the invention, the radial length of the first part is set to be longer than the radial length of the second part.

In another preferred embodiment of the invention, the first part and the second part are connected by a curving portion.

Effect of the Invention

Thus according to the invention, projection material can be thoroughly projected onto a workpiece using a single projector unit, therefore the shot processing apparatus can be constrained from growing in size.

BRIEF DESCRIPTION OF FIGURES

FIG. 7A is a front elevation; and FIG. 7B is a side elevation thereof.

FIG. 13A is a front elevation view of the blade; FIG. 13B is a left side elevation view; FIG. 13C is a rear elevation view; FIG. 13D is a cross sectional view seen along line S1-S1 in FIG. 13A; FIG. 13E is a plan view (top view); and FIG. 13F is a bottom view (underside view).

FIGS. 14A-14D are perspective views from respectively different directions.

FIG. 15A is a front elevation cross sectional view showing a side plate unit with the blade attached; FIG. 15B is an enlarged view showing the portion of dotted line B1; and FIG. 15C is a rear elevation view of the side plate unit with the blade attached.

FIG. 16A is a front elevation cross sectional view showing the side plate unit; and FIG. 16B is a cross sectional view seen along line S2-S2 shown in FIG. 16A.

FIG. 18A is a cross sectional view showing a rotationally driven blade, a side plate unit, and a distributor; FIG. 18B is a cross sectional view of a liner.

FIGS. 19A-19N are diagrams for explaining the advantages of pitching the first part of the blade rearward. FIGS. 19A-19G are diagrams showing the behavior of projection material resulting from the rearward pitching blade according to the present invention; and FIGS. 19H-19N are diagrams showing the behavior of a conventional forward-pitched blade for comparison thereto.

FIG. 20A is a front elevational view of the blade; FIG. 20B is a left side elevational view; FIG. 20C is a rear elevational view; FIG. 20D is a cross sectional view seen along line S3 S3 shown in FIG. 20A; FIG. 20E is a plan view (top view); and FIG. 20F is a bottom view (underside view).

FIGS. 21A-21D are perspective views from respectively different directions.

FIGS. 22A-22N are diagrams showing another example of a blade which can be used in a centrifugal projector according to an embodiment of the invention. FIG. 22A is a side elevational view of a control cage with an opening window; FIG. 22B is a side elevational view of a control cage with two opening windows; FIG. 22C is a side elevational view of a control cage with one opening window in which portions of two rectangles are overlapped and integrated; FIG. 22D is a side elevational view of a control cage with a parallelogram opening window; FIGS. 22E-22F are side elevational views of a control cage with a single opening window in which parts of three or more squares are overlapped and integrated; and FIGS. 22G-22N are diagrams showing the projection distribution, etc., of each control cage.

DETAILED DESCRIPTION OF THE PREFERRED EMBODIMENTS

Below, referring to FIGS. 1 through 9, we explain a shot peening apparatus 10, being a first embodiment of the shot peening apparatus of the invention. Note that in the diagram the arrow FR denotes the front side viewed from the front of the apparatus, the arrow UP denotes the upper side of the apparatus, and the arrow LH denotes the left side viewed from the front of the apparatus.

Figure 1:
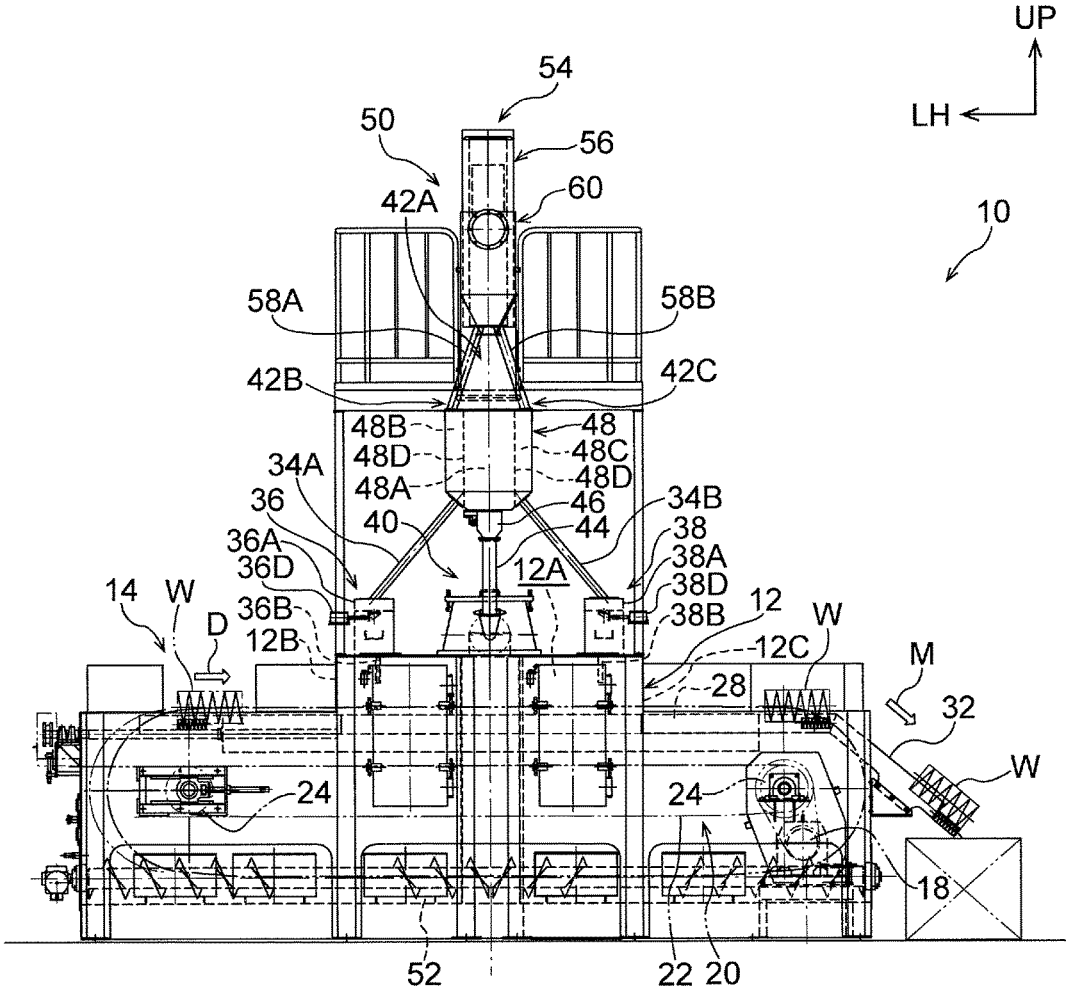
FIG. 1 is a front elevation of a shot peening apparatus according to a first embodiment of the invention.
Figure 2:
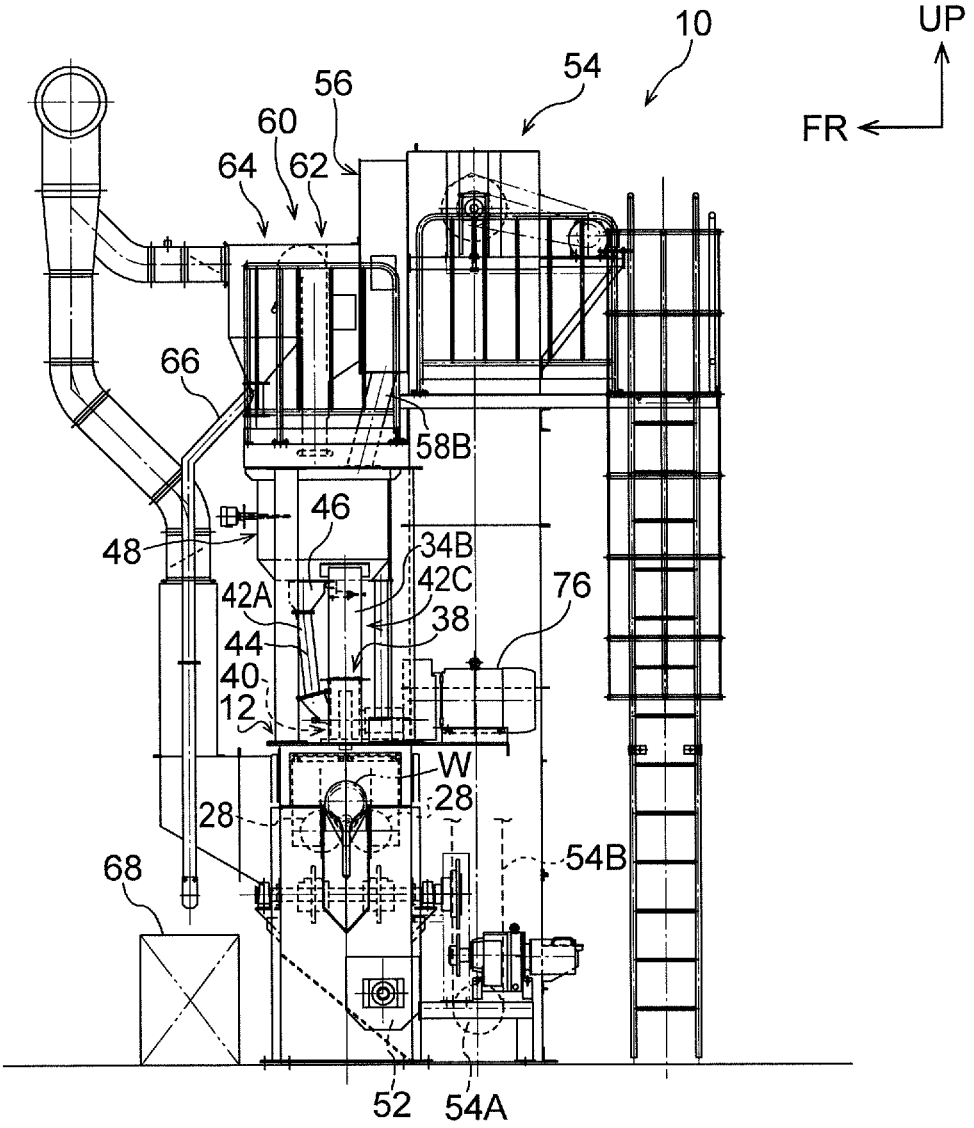
FIG. 2 is a right side elevation of the FIG. 1 shot peening apparatus.
Figure 3:
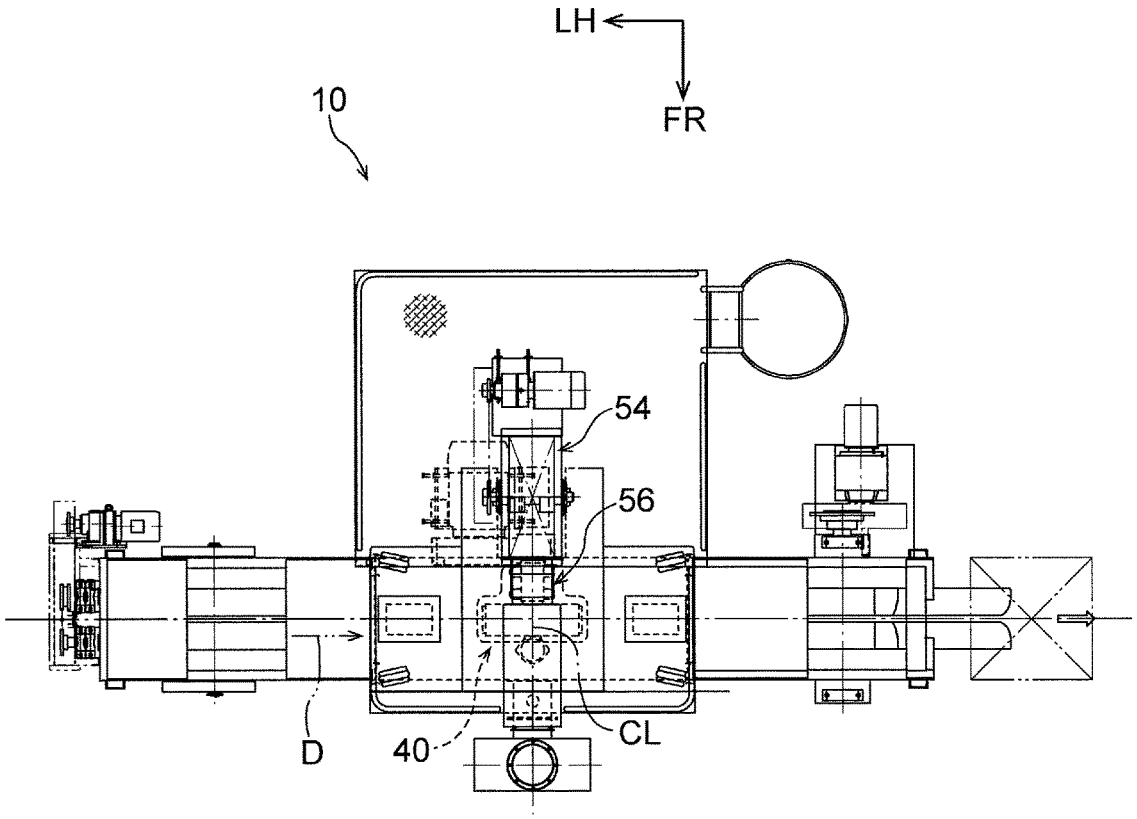
FIG. 3 is a plan view elevation of the FIG. 1 shot peening apparatus.

FIG. 1 is a front elevation of the shot peening apparatus 10; FIG. 2 is a right side elevation of the shot peening apparatus 10; FIG. 3 is a plan view of the shot peening apparatus 10. The primary workpieces W for the shot peening apparatus 10 are coil springs. Note that arrow D in the diagram indicates the workpiece W transport direction (referred to as simply "transport direction" below).

As shown in FIG. 1, the shot peening apparatus 10 comprises a cabinet 12. The cabinet 12 comprises an outer wall portion dividing inner space from outer space so that projection material (referred to as shot or shot material; e.g., "steel balls") does not scatter outside the cabinet 12. The ground contact surface on the bottom of the apparatus is arranged so that heights in the vertical direction of the apparatus are the same.

A projection chamber 12A (also referred to as a "projection booth," "treatment chamber," or "blasting cleaning chamber") is formed on the interior of the cabinet 12. The projection chamber 12A is a booth for performing "peening"

on a workpiece W using projection material projected by a projector 40, described below.

On the cabinet 12, a projection chamber inlet 12B is formed on the upstream side in the transport direction (left side in FIG. 1), and a projection chamber outlet 12C is formed on the downstream side in the transport direction (FIG. 1, right side). The projection chamber inlet 12B is an opening for loading a workpiece W into the projection chamber 12A; projection chamber outlet 12C is an opening for discharging the workpiece W from the projection chamber 12A.

On the upstream side of the cabinet 12 in the transport direction (left side of FIG. 1), a setting portion 14 is provided for setting a workpiece W introduced into the shot peening apparatus 10. Note that when a manual setting action is difficult due to the weight of the workpiece W or temperature, etc., a transport apparatus (not shown) may be provided on the setting portion 14 so that the workpiece W can be mechanically set in place using this transport apparatus.

A workpiece transport mechanism for moving the workpiece W along the transport path is disposed inside the cabinet 12. The workpiece transport apparatus comprises a pair of cylindrical spinner rollers 28 disposed to extend along the transport direction, and a chain conveyor 20. Each of the two spinner rollers 28 has the same dimensions and shape.

The pair of spinner rollers 28 is constituted so that the workpiece W is loaded onto the top portion thereof. More specifically, they are constituted so that the workpiece W is received in an indentation formed between the top surfaces of two parallel disposed spinner rollers 28. In addition, the pair of spinner rollers 28 is rotationally driven in the same direction about the center of the longitudinal direction axis, and the loaded workpiece W can be rotated (self-rotated) on the spinner rollers 28.

The chain conveyor 20 comprises an endless chain 22, and multiple attachments 26 as transport members attached on the outer side of the endless chain 22. The endless chain 22 is wound around sprockets 24 disposed on the upstream side of the projection chamber inlet 12B and the downstream side of the projection chamber outlet 12C, and is disposed to extend in the transport direction (the direction of arrow D). The sprockets 24 are connected to a drive source 18, and can be continuously rotationally driven.

Figure 8:
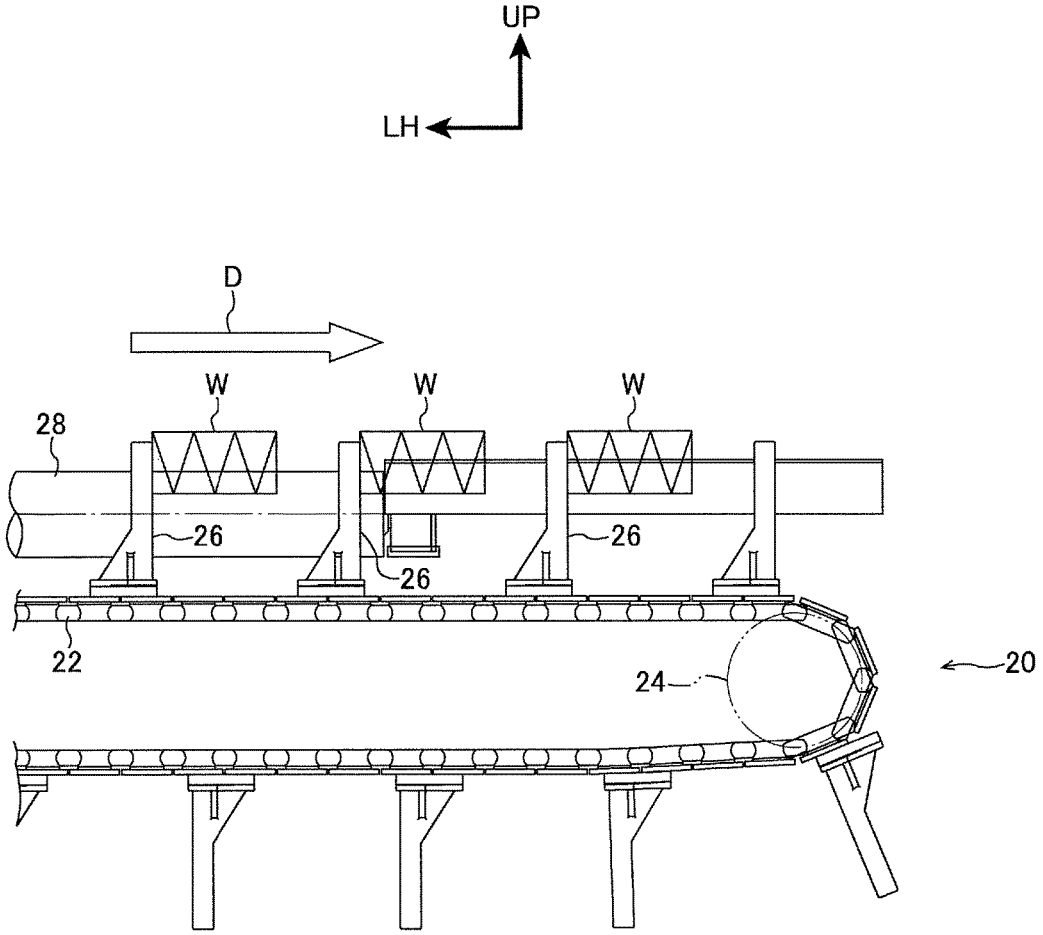
FIG. 8 is a front elevation showing the state in which a workpiece is transported in the FIG. 1 shot peening apparatus.

FIG. 8 is a front elevation explaining the state of transport of the workpiece W by the chain conveyor 20. Note that in FIG. 9 the spinner roller 28 disposed on the front side is omitted from the pair of spinner rollers 28. As shown in FIG. 8, the attachments 26 attached on the outside of the endless chain 22 are attached at equal spacing along the endless chain 22 so that the rod-shaped main part thereof projects out from between the pair of spinner rollers 28 toward the outside of the chain 22.

Figure 7A:
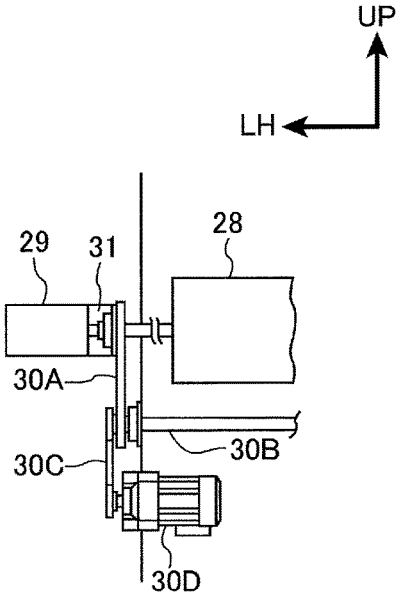
FIGS. 7A and 7B are figures showing a spinner roller displacement adjustment mechanism for the shot peening apparatus in FIG. 1.
Figure 7B:
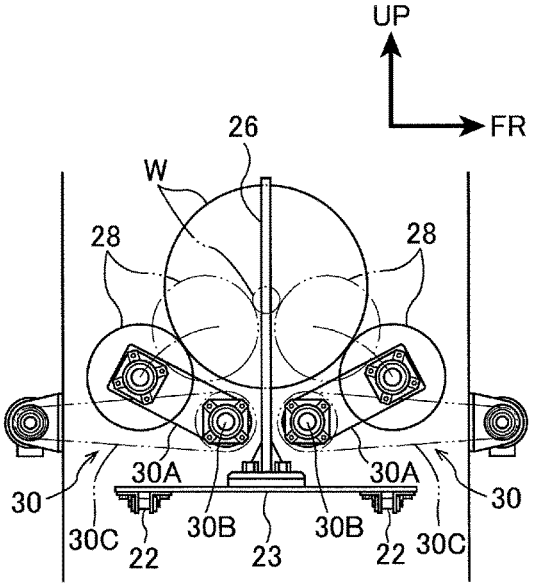

As shown in FIG. 7B, a left-right pair of chains 22 sandwiches the attachments 26. The attachments 26 are attached so as to extend upward on a chain plate 23, which spans between and is supported by the left-right pair of chains 22.

When the chains 22 are rotationally driven, the rod-shaped main part pushes the back end of the workpiece W loaded on the pair of spinner rollers 28 in the transport direction (the arrow D direction), and the attachments 26 move the workpiece W on the pair of spinner rollers 28 continuously downstream in the transport direction.

As described above, the pair of spinner rollers 28 is rotationally driven about their longitudinal axis, causing the loaded workpiece W to rotate, therefore the workpiece W is transported by the attachments 26 as it is made to turn on its own on the pair of spinner rollers 28.

A gap adjustment mechanism 30 for adjusting the gap between the pair of spinner rollers 28 is connected to the axial portion of the pair of spinner rollers 28. The gap adjustment mechanism 30 comprises a pair of rotary arms 30A mounted below each of the spinner rollers 28. The end portions of the rotary arms 30A support the axial portions of the pair of spinner rollers 28 so that they are able to rotate about the axes thereof. The base end portions of each rotary arm 30A are respectively connected to a rotary shaft 30B, disposed below the spinner rollers 28 and extending parallel to the spinner rollers 28.

As shown in FIG. 7A, the rotary shafts 30B are rotatably supported on the apparatus frame side, and are connected to the output shaft side of a drive motor 30D serving as drive source through endless belt 30C. By this configuration, the rotary shaft 30B gap adjustment mechanisms 30 oscillate the rotary arms 30A about the rotary shafts 30B such that the spinner rollers 28 can be displaced along the arc-shaped path, as shown in FIG. 7B.

Therefore in the present embodiment a large diameter workpiece W can be loaded on the spinner rollers 28 by causing the rotary arms 30A of the gap adjustment mechanism 30 to oscillate outward, positioning the pair of spinner rollers 28 at a position shown by the solid line in FIGS. 7A and 7B. Workpieces W of differing sizes can thus be appropriately handled.

Also, as shown in FIG. 7A, a drive motor 29 is fixed to the end portion of the rotary arms 30A via brackets 31, and the output shaft of the drive motor 29 is connected to the shaft portion of the spinner rollers 28. This enables the spinner rollers 28 to rotate in the same direction about the axis, as described above.

As shown in FIG. 1, a discharge chute 32 is provided on the downstream side of the cabinet 12 in the transport direction. The upstream side end portion of the discharge chute 32 is adjacent to the downstream side end portion of the spinner rollers 28, and as a whole inclines downward toward the transport direction downstream side. That is, the discharge chute 32 is treated as a passage for discharging workpieces W transported on the spinner rollers 28 in the direction of the arrow M.

A centrifugal projector 40 is attached to the upper wall portion of the cabinet 12. The projector 40 is disposed on the top side of the pair of spinner rollers 28 and projects projection material toward workpieces W transported on the pair of spinner rollers 28. Details of the projector 40 are discussed below.

A projection material introducing pipe 44 (also referred to as the "introducing pipe") is disposed on the top side of the projector 40. The top end of this projection material introducing pipe 44 is connected to a projection material hopper 48 (also referred to as the "shot tank") through a cut gate 46 (also referred to as the "flow adjustment apparatus"). Projection material hopper 48 is a hopper for temporarily holding projection material. The interior space of the projection material hopper 48 is divided into three parts in the left-right direction of the apparatus by a pair of left-right partition walls 48D. That is, the projection material hopper 48 comprises a main portion 48A positioned between the pair of partition walls 48D, and a pair of adjacent side portions 48B, 48C on both the left and right sides of the main portion 48A. The cut gate 46 described above is connected to the bottom of the main portion 48A of the projection material hopper 48. Note that cut gate 46 is a shutoff gate for adjusting the flow volume of projection material supplied from the main portion 48A of the projection material hopper 48.

The bottom of the side portion 48B on the left side of the projection material hopper 48 is connected to a first shot curtain apparatus 36 through a supply pipe 34A. The first shot curtain apparatus 36 is disposed on the diagonally upper side of the projection chamber inlet 12B, and is fixed to the cabinet 12. The first shot curtain apparatus 36 comprises a container portion 36A connected to the supply pipe 34A, and comprises a downward facing rectangular pipe 36B, connected to the bottom of the container portion 36A. The rectangular pipe 36B is an outflow pipe for projection material with a rectangularly formed cross section.

The interior space of the container portion 36A is partitioned by an upper partitioning panel into an upper space and a lower space below. A gate mechanism 36D capable of opening and closing an opening on the upper partitioning panel is installed on the first shot curtain apparatus 36. Inside the container portion 36A, an indented receiving portion is provided on the lower side of the upper partitioning panel opening portion; the receiving portion is configured to first receive projection material which has dropped through the opening portion in the upper partitioning panel, then supply it to the lower side.

The first shot curtain apparatus 36 constituted in this manner enables projection material supplied from the supply pipe 34A to be continuously dropped (creating what is known as a shot curtain) from the rectangular pipe 36B through the container portion 36A. That is, the projection chamber inlet 12B side is a structure by which the shot curtain is opened and closed through the opening and closing of the gate mechanism 36D.

Also, the bottom of the side portion 48C on the right side of the projection material hopper 48 is connected to a second shot curtain apparatus 38 through the supply pipe 34B. A second shot curtain apparatus 38 is disposed on the diagonally upper side of the projection chamber outlet 12C, and is fixed to the cabinet 12. The second shot curtain apparatus 38 comprises a container portion 38A connected to the supply pipe 34B, and comprises a downward facing rectangular pipe 38B, connected to the bottom of the container portion 38A. The rectangular pipe 38B is an outflow pipe for projection material with a rectangularly formed cross section.

The interior space of the container portion 38A is also partitioned by an upper partitioning panel into an upper space and a lower space below same. A gate mechanism 38D capable of opening and closing an opening on the upper partition panel is installed on the second shot curtain apparatus 38. Inside the container portion 38A an indented receiving portion is provided on the lower side of the upper partitioning panel opening portion; the receiving portion is configured to first receive projection material which has dropped through the opening portion in the upper partitioning panel, then supply it to the lower side.

The second shot curtain apparatus 38 thus constituted enables projection material supplied from the supply pipe 34B to be continuously dropped (creating what is known as a shot curtain) from the rectangular pipe 38B through the container portion 38A. That is, the projection chamber outlet 12C side is a structure by which the shot curtain is opened and closed through the opening and closing of the gate mechanism 38D.

Also, the projector 40 is disposed at a position above the cabinet 12 between the first shot curtain apparatus 36 and the second shot curtain apparatus 38. The projector 40 is connected to the circulation apparatus 50 through the projection material introducing pipe 44, the cut gate 46, and main portion 48A of the projection material hopper 48. The circulation apparatus 50 is an apparatus for transporting projection material projected onto the workpiece W and circulating it to the projector 40, and comprises a lower portion screw conveyor 52 on the bottom side of the chain conveyor 20 inside the cabinet 12.

The lower portion screw conveyor 52 is horizontally disposed so as to extend along the transport direction (the arrow D direction). The spiral winding directions of the screw blades in the lower portion screw conveyor 52 are opposite between the region disposed on the right side (downstream side) of the apparatus and the region disposed on the left side (upstream side) of the apparatus. That is, the screw blades on the lower portion screw conveyor 52 are disposed to transport the projected projection material, etc., to the center portion side in the left-right direction of the apparatus. The end portion on the transport downstream side of the lower portion screw conveyor 52 is disposed at a position facing the lower collection portion of the bucket elevator 54 shown in FIG. 2. That is, the bucket elevator 54 communicates with the lower portion screw conveyor 52 and forms a recovery pathway for recovering projection material projected onto the workpiece W.

The bucket elevator 54 of the present embodiment has the same structure as bucket elevators of known structures; an endless belt 54B is wound around pulley 54A, disposed on the upper portion and the lower portion of the shot peening apparatus 10 (only the lower pulley is shown in the figure), and a large number of buckets (not shown) are attached to the endless belt 54B. The pulley 54A is rotationally driven by a motor. The bucket elevator 54 is thus configured to scoop up projection material and the like which has dropped to the bottom of the apparatus and been recovered by the lower portion screw conveyor 52 (mixtures of projection material projected onto the workpiece W with powder/particle foreign material) with a bucket, transporting it from the bottom to the top portion (top part of cabinet 12) of the apparatus.

A distribution box 56 is disposed at the top end portion of the bucket elevator 54; the distribution box 56 communicates with the top ejecting port on the bucket elevator 54. As shown in FIGS. 1 and 2, the distribution box 56 distributes projection material ejected from the bucket elevator 54 into a first route 42A for supplying the projector 40, a second route 42B for supplying the first shot curtain apparatus 36, and a third route 42C for supplying the second shot curtain apparatus 38.

The first route 42A is a route by which projection material moves from the distribution box 56 through the separator 60, the projection material hopper 48 main portion 48A (see FIG. 1), the cut gate 46, and the projection material introducing pipe 44 to the projector 40.

Also, the second route 42B shown in FIG. 1 is the route by which projection material moves from the distribution box 56 through, the distribution pipe 58A, the left side portion 48B of the projection material hopper 48, and the supply pipe 34A to the first shot curtain apparatus 36.

In addition, the third route 42C is the route by which projection material moves from the distribution box 56 through the distribution pipe 58B, the right side portion 48C of the projection material hopper 48, and the supply pipe 34B to the second shot curtain apparatus 38.

The top end portion of the bucket elevator 54, as shown in FIG. 2, is connected through the distribution box 56 to a separator 60, and to the first shot curtain apparatus 36 (see FIG. 1) and the second shot curtain apparatus 38 through only the distribution box 56, not through the separator 60.

The separator 60 is provided on a recovery path for recovering projection material projected onto the workpiece W, and comprises an air separator mechanism 62. The air separator mechanism 62 is connected to the intake side of a dust collector, not shown, through a settling chamber portion 64. Note that the dust collector has the purpose of recovering foreign objects (impurities) such as fine powders mixed into the projection material, and comprises an intake portion (blower) for intaking air.

The air separator mechanism 62, by applying an upward air current to a falling mixture of projection material and powder/particle foreign objects while allowing the mixture to naturally drop, separates light objects borne on air currents from heavy objects which drop. A main portion 48A of a projection material hopper 48 (see FIG. 1) is disposed on the bottom side of the air separator mechanism 62. The air separator mechanism 62, by taking advantage of natural dropping, is thus constituted to supply reusable projection material to the projection material hopper 48 main portion 48A (see FIG. 1).

The settling chamber portion 64 is placed on the downstream side of the light object flow path in the air separator mechanism 62, and intaken particles in air are separated (sorted) by a bypass current. Of the intaken powder/particle objects (foreign objects), the settling chamber portion 64 allows smaller particle size light weight powder/particles (powders) ride on air currents, discharging them to the dust collector side, and allows relatively large particle size heavy powder/particles (powders) to drop, discharging them through a course sorting pipe 66 into a course sorting case 68.

Next, referring to FIGS. 4 through 6, details of the projector 40 will be explained.

Figure 4:
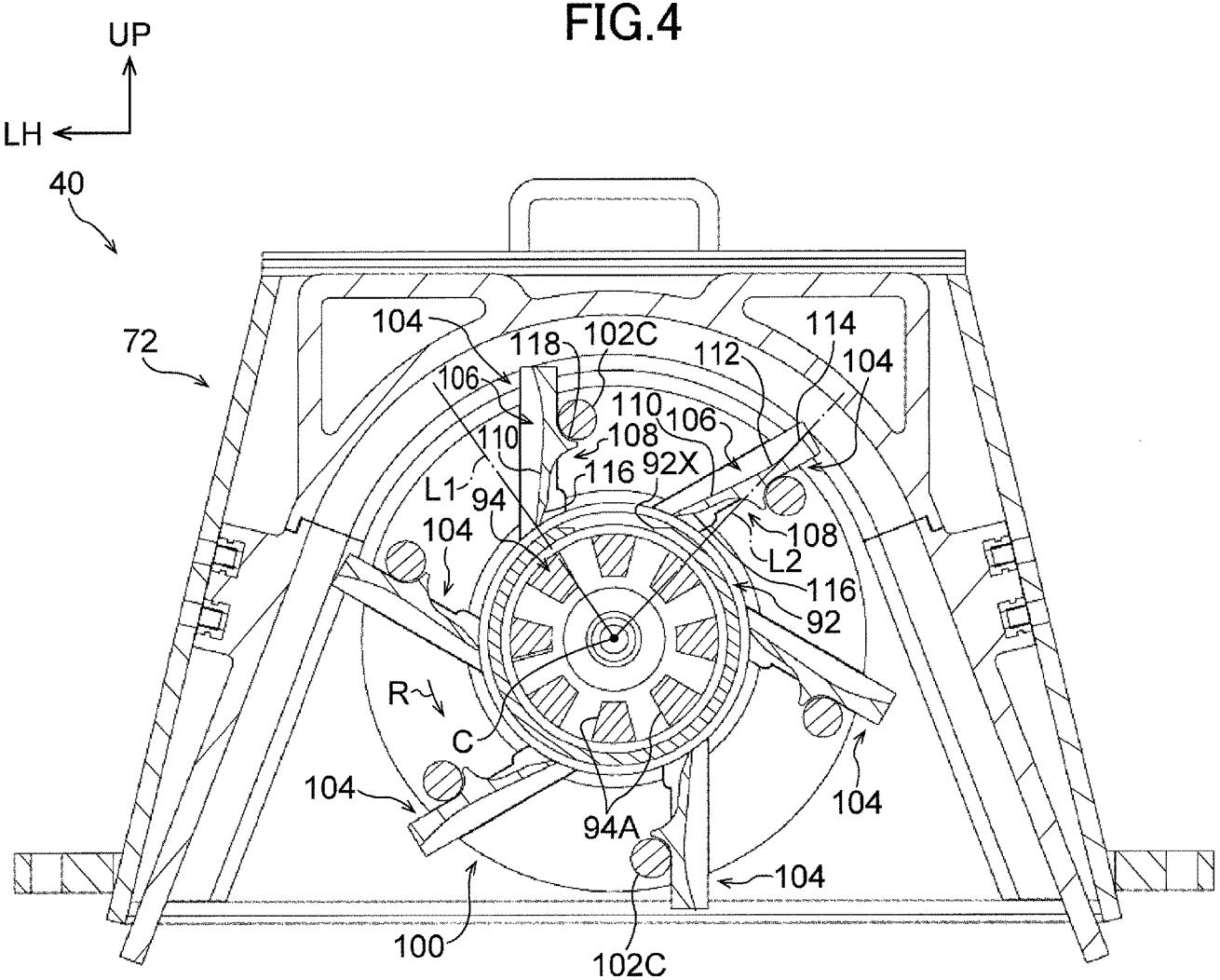
FIG. 4 is a cross section of the FIG. 1 projector in front view.

FIG. 4 is a cross section of projector 40 seen from the front. FIG. 5 is a vertical cross section of projector 40 seen from the side. As shown in these figures, the projector 40 comprises a case main body 72. This case main body 72 has approximately a truncated pyramid shape on the outside; the bottom side (bottom side in FIG. 4) thereof is open and serves as a projection material projecting portion. As shown in FIG. 5, left and right bases 72A extend in a mutually separating direction from the bottom of the case main body 72, and these bases 72A are fixed to the top wall portion of the cabinet 12 (see FIG. 1).

Figure 5:
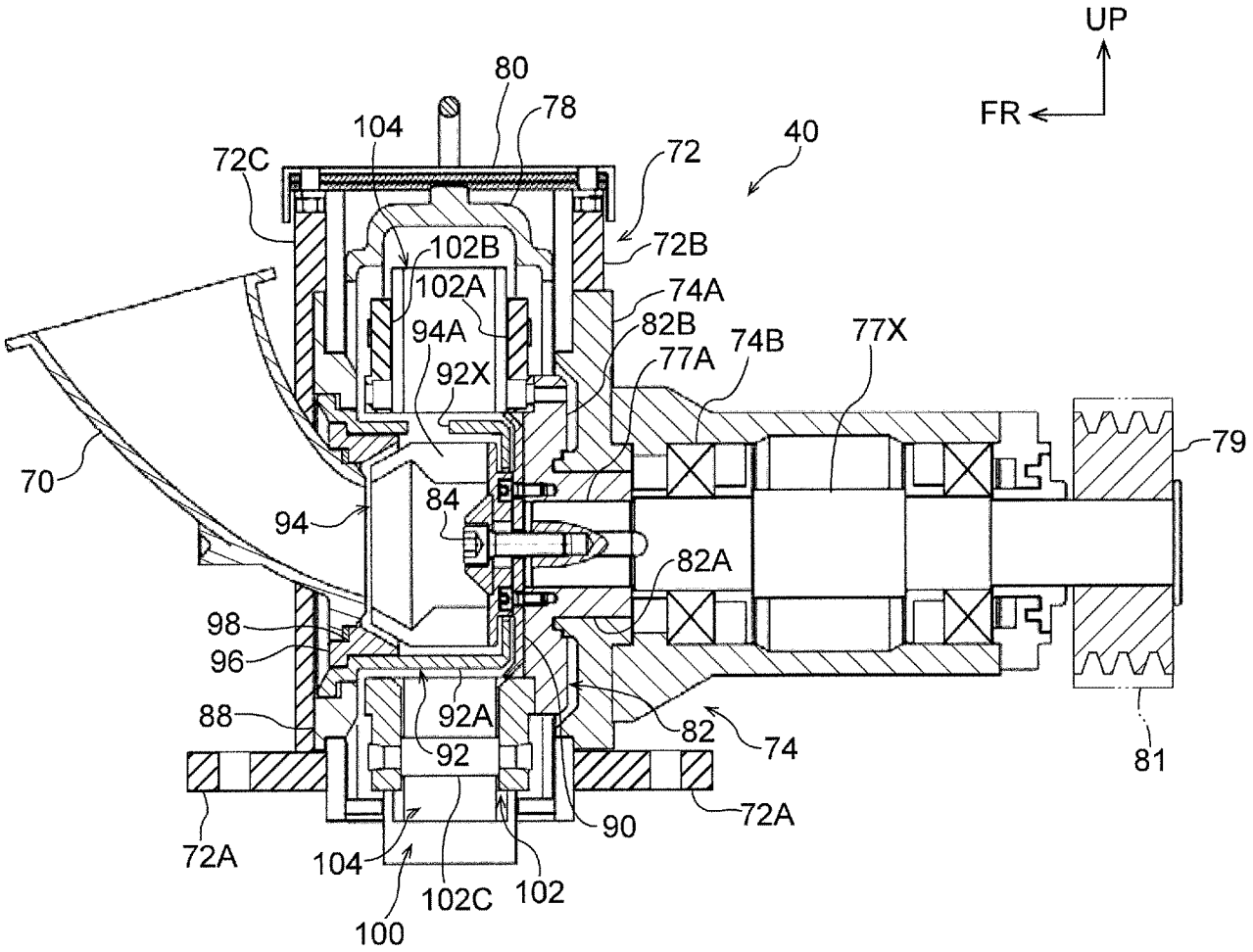
FIG. 5 is a vertical cross section of the FIG. 1 projector in side view.

A through hole, through which the tip portion of a hub unit 74 or the like is inserted, is formed on the side portion 72B at the back side of the case main body 72 as seen from the front of the apparatus (FIG. 5, right side). On the other hand, a through hole for insertion of an introducing cylinder 70 is formed on the side portion 72C at the front side of the case main body 72 as seen from the front of the apparatus (FIG. 5, left side). A projection material introducing pipe 44 (see FIG. 1) is connected to the introducing cylinder 70. Further, a cover 80 is attached at the peak portion of the case main body 72; a through hole is formed on this cover 80, into which the upper part of a liner 78 is inserted. The liner 78 is attached to the inside of the case main body 72.

A control cage 92 is disposed at the center of the interior of the case main body 72. The control cage 92 is attached through a front surface cover 88 to the side portion 72C on the front side (FIG. 5, left side) of the case main body 72 as seen from the front of the apparatus. The control cage 92 has a cylindrical shape, is disposed concentrically with rotary shaft 77X, and is configured so that projection material is supplied to the interior from the introducing tube 70. This control cage 92 is disposed so that, as shown in FIG. 3, its central axis CL extends in a direction perpendicular to the transport direction (arrow D direction) as seen in apparatus plan view. As shown in FIG. 5, a ring-shaped bracket 96 and a seal member 98 are disposed between the inside circumferential portion of the opening end at the front side of the control cage 92 as seen from the apparatus front (FIG. 5, left side) and the outer circumferential portion of the introducing tube 70. Note that a portion of the introducing tube 70 is fixed to the main body of the projector 40 by an introducing tube hold-down (not shown).

A first opening 92X and a second opening 92Y (see FIG. 6), penetrating the side wall 92A and serving as the projection material discharge portion, are formed on the side wall 92A of the control cage 92. As shown in FIG. 6, which is a side elevation of the control cage 92, the first opening 92X and the second opening 92Y comprise a rectangular shape which includes two sides parallel to the central axis CL of the control cage 92. The first opening 92X and the second opening 92Y have the same dimensions and shapes. Also, the first opening 92X and the second opening 92Y are disposed so as to mutually separate in the circumferential direction of the control cage 92, and to be offset in the axial direction of the control cage 92. The first opening 92X and the second opening 92Y are disposed on top of the control cage 92 so as not to overlap in the circumferential direction.

As shown in FIG. 5, the tip portion 74A of the hub unit 74 communicates with the center portion of the case main body 72 at the right side of the figure. More particularly, the tip portion 74A of the hub unit 74 is connected to the side portion 72B of the case main body 72 at the right side of the figure. The hub unit 74 comprises a bearing 74B, and rotatably supports the rotary shaft 77X.

A second pulley 79 is attached to the base end portion of the rotary shaft 77X. An endless belt 81 is wound around this second pulley 79 and around a first pulley (not shown) attached to the rotary shaft of the driving motor 76 (see FIG. 2). The rotary force of the driving motor 76 (see FIG. 2) is, by this means, transferred to the rotary shaft 77X.

The cylindrical portion 82A of the hub 82, which is a flanged cylindrical body, is fixed by a key to the rotary shaft 77X tip portion 77A. A center plate 90 is bolt-fixed to the hub 82 by a bolt. A distributor 94 is fixed through the center plate 90 by a bolt 84 to the tip portion 77A of the rotary shaft 77X.

As shown in FIG. 4, the distributor 94 is disposed on the inside of the control cage 92. The distributor 94 comprises multiple blades 94A extending radially inward, and multiple openings disposed at regular interval in the circumferential direction, and is disposed on the inside of the control cage 92 so as to form a gap with respect to the control cage 92. The distributor 94 rotates by activation of a drive motor 76 (see FIG. 2), and rotates inside the control cage 92.

Rotation of the distributor 94 causes projection material supplied from the introducing tube 70 to the inside of the control cage 92 to be mixed inside the distributor 94, then supplied by centrifugal force to the gap between the distributor 94 and the control cage 92 from and through an opening in the rotating distributor 94. Projection material supplied to this gap moves within the gap in the rotational direction along the inside circumferential surface of the control cage 92, and is discharged in the radially outward direction from the opening 92X and the opening 92Y in the control cage 92.

At this point the direction of discharge of projection material from the first opening 92X and the second opening 92Y on the control cage 92 (see FIG. 6) is inclined in the rotational direction (arrow R direction) of the blade wheel 100 relative to the radial direction from the rotational center of the distributor 94 (same as the rotational center C of the blade wheel 100 described below).

As shown in FIG. 5, a flange 82B extending radially outward from one end portion in the axial direction of the cylindrical portion 82A of hub 82 is bolt-fixed to a ring-shaped first side plate 102A on a side plate unit 102. The side plate unit 102 constitutes a portion of a blade wheel 100 disposed on the outer circumferential side of the control cage 92. The blade wheel 100 comprises a first side plate 102A and a cylindrical second side plate 102B disposed to face the first side plate 102A, separated by a gap. The first side plate 102A and second side plate 102B are connected by a connecting member 102C.

Figure 9:
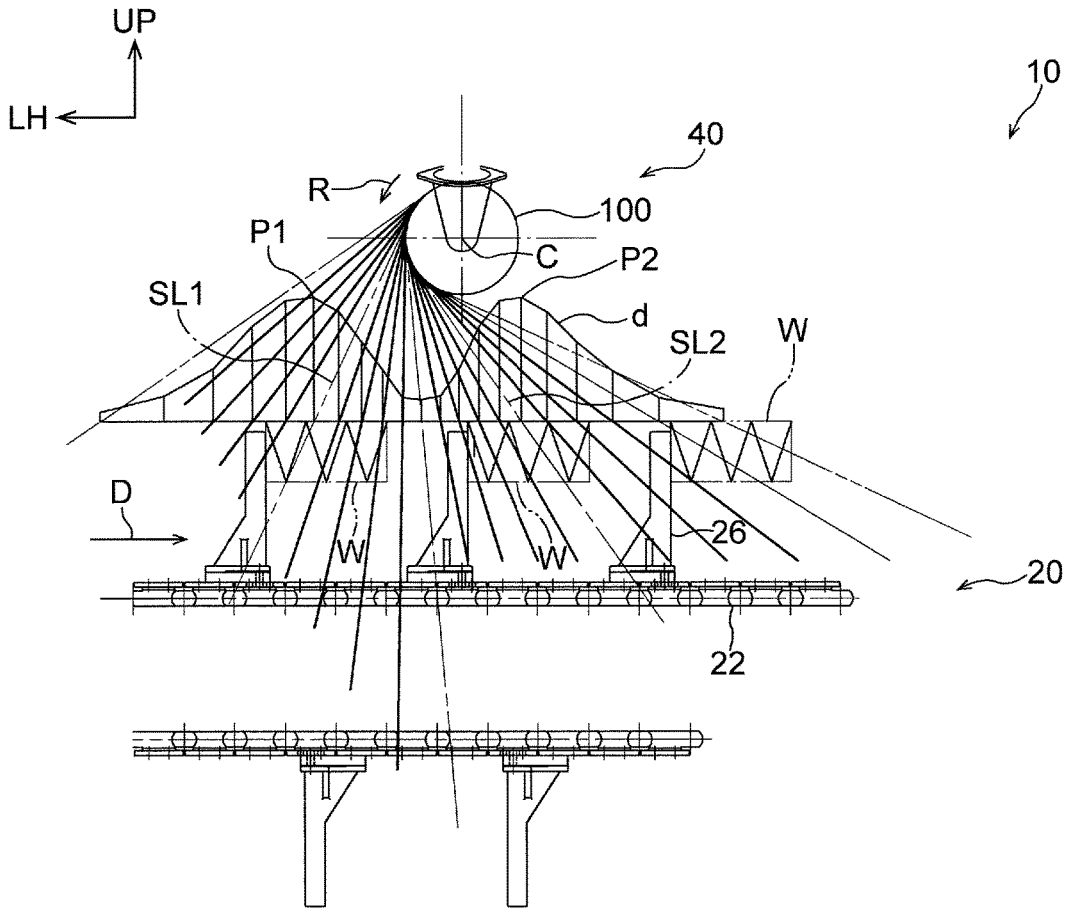
FIG. 9 is a diagram showing the projection material projection distribution by the FIG. 1 shot peening apparatus.

In addition, the blade wheel 100 comprises multiple blades 104 disposed to extend in the radially outward direction of the control cage 92 between the first side plate 102A and the second side plate 102B. The blade wheel 100 obtains rotary force by the action of the drive motor 76 (see FIG. 2) and rotates in the circumferential direction of the control cage 92. The rotational direction of the blade wheel 100 and the rotational direction of the distributor 94 are set to be the same. Each blade is disposed along the outer circumference of the control cage 92 with its radial outward end on the outer circumferential side of the control cage 92 in an inclining orientation so as to be positioned on the rear side in the rotational direction (arrow R direction) of the blade wheel 100. The rotary axis of the blade wheel 100 extends in a direction perpendicular to the transport direction and, as shown in FIG. 9, the rotational direction (arrow R direction) is set so that the blade wheel 100 blades 104 move from the upstream side to the downstream side in the transport direction of the chain conveyor 20 side (the transport path side).

As shown in FIG. 4, the surface 106 on the rotational direction front side of the blades 104 comprises a rearward inclining portion 110 sloping to the rear side in the rotational direction at the radial inward (based end) side part. It is preferable for the rearward inclining portion 110 to incline at an angle of 30° to 50° relative to the blade wheel 100 radial direction, toward the rotational direction rear; in the present embodiment it inclines at 40°.

A non-rearward inclining portion 114 extending essentially in the radial direction from the rotational center C of the blade wheel 100 is formed on the tip side of the blade 104 surface 106 (i.e., on the radial outside of the rearward inclining portion 110). That is, in the non-rearward inclining portion 114 the sloping angle toward the rotary rear direction is set to be smaller than the rearward inclining portion 110. That is, in the non-rearward inclining portion 114 the sloping angle toward the rotary rear direction is set to be smaller than the rearward inclining portion 110.

The radial length of the rearward inclining portion 110 is set to be longer than the radial length of the non-rearward inclining portion 114. The rearward inclining portion 110 and the non-rearward inclining portion 114 are connected by a curved portion 112.

The surface 108 on the opposite side of the surface 106 of the blade 104 has, at its base end, a inclined portion 116, which inclines more to the rear side in the rotational direction than the rearward inclining portion 110 relative to the radial direction. A protuberance 118 is raised on the radial middle portion of the surface 108 of the blades 104. On this protuberance 118, the indented curved portion on the radial outer side of the blade wheel 100 contacts the connecting member 102C.

Next the operation and effect of the shot blasting apparatus of the present embodiment will be explained.

As shown in FIG. 8, the workpiece W is transported by being pushed in the transport direction (arrow D direction) by attachments 26 when the chains 22 are rotationally driven. The workpiece W loaded on the pair of spinner rollers 28 is caused to rotate by the rotation of the spinner rollers 28 during transport by the attachments 26, therefore projection material projected from the projector 40 collides with the entire outer circumference of the workpiece W, and the entirety of the workpiece W is thoroughly shot-processed.

As shown in FIG. 4, in the projector 40, the blade wheel 100 disposed on the outer perimeter side of the control cage 92 accelerates and projects projection material discharged from the control cage 92 by the blades 104. As shown in FIG. 9, projection material thus accelerated and projected by the rotation of the blade wheel 100 is somewhat dispersed as it is projected. In the present embodiment the central axis (the axis matching the rotational center C of the blade wheel 100) of the control cage 92 (see FIG. 4) is disposed so as to face in a direction perpendicular to the workpiece W transport direction (arrow D direction) as seen from the apparatus front, therefore projection material projected by the rotation of the blade wheel 100 is projected so as to diffuse in the workpiece W transport direction.

Here, as shown in FIG. 4, a rearward inclining portion 110 is formed on the surface 106 of the blade 104 of the blade wheel 100 so as to inline to the rear side in the rotational direction (arrow R direction) relative to the radial direction of the blade wheel 100. For this reason the timing at which projection material first projected from the control cage 92 contacts the surface 106 of the blade 104 can be delayed. This means that at the point in time when the first discharged projection material contacts the blade 104 surface 106, later-discharged projection material and earlier-discharged projection material are gathered at a position close to the blade 104 surface 106. As a result, projection material can be more efficiently concentrated at the rearward inclining portion 110 by the surface 106 of the blade 104. In other words, the dispersion width of the projection of projection material discharged from a predetermined position in the circumferential direction of the control cage 92 toward the workpiece W transport direction can be constrained and concentrated.

Figure 6:
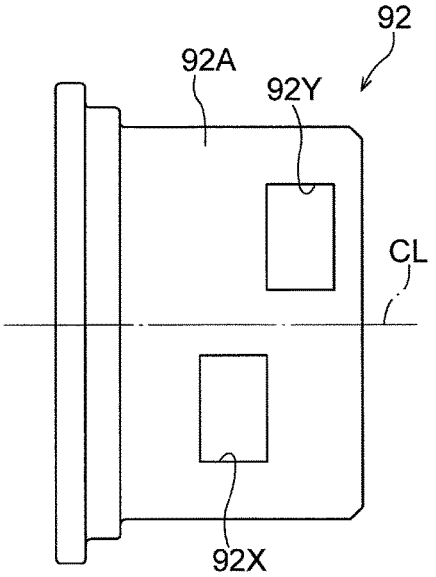
FIG. 6 is a side elevation of the control cage on the FIG. 1 projector.

Also, as shown in FIG. 6, the control cage 92 comprises two openings, first opening 92X and second opening 92Y, which serve as projection material discharge portions. The first opening 92X and the second opening 92Y are disposed so as to mutually separate in the circumferential direction of the control cage 92, and to be offset in the axial direction of the control cage 92. The first opening 92X and the second opening 92Y are disposed on the control cage 92 so as not to overlap in the circumferential direction.

By this configuration, projection material respectively projected from the first opening 92X and the second opening 92Y is respectively discharged from separated positions in the circumferential direction of the control cage 92 and projected at an offset to the workpiece W transport direction (arrow D direction) shown in FIG. 9, while the respective dispersion widths thereof are constrained.

Therefore as shown in FIG. 9, the projection distribution curve d is as a whole an essentially M-shaped distribution curve combining two projection distribution curves with constrained dispersion widths, having two projection peaks P1, P2 in an effective projection range owing to the projector 40. Hence the workpiece W can be shot processed in a well-balanced manner from the diagonally upward side on the downstream side of the transport direction and the diagonally upward side on the upstream side of the transport direction within an effective projection range resulting from a single projector 40. That is, the shot processing is performed thoroughly over the entire circumference of the spring wire of the workpiece W.

Note that SL1 in FIG. 9 indicates the central axis of the projection direction from the diagonally upper side on the downstream side in the transport direction relative to a workpiece W; that direction indicates the direction of the projection which forms the first projection peak P1. SL2 in the figure indicates the central axis of the projection direction from diagonally upper side on the upstream side of the transport direction relative to a workpiece W; that direction indicates the direction of the projection which forms the second projection peak P2.

Figure 10:
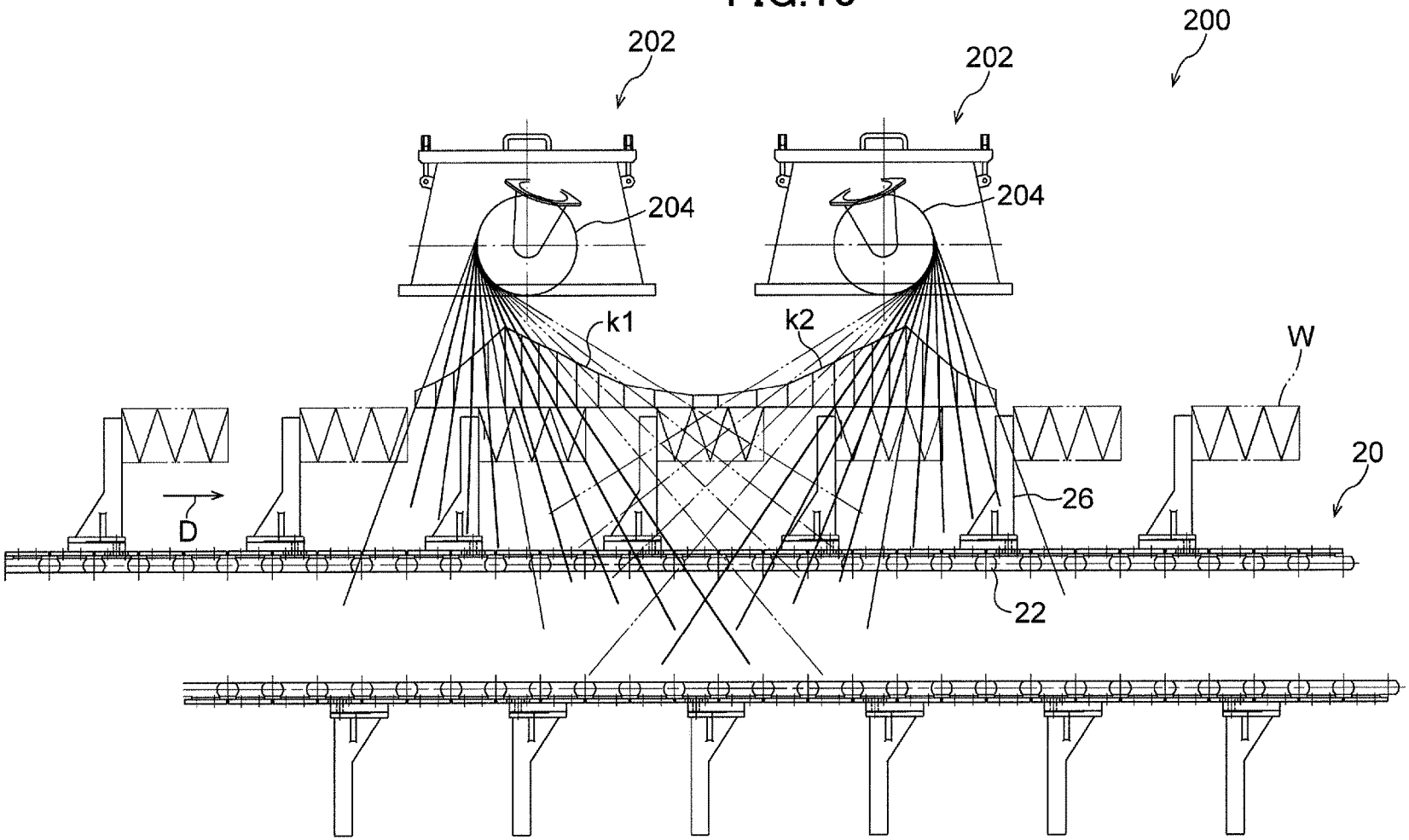
FIG. 10 is a diagram showing the projection material projection distribution by a shot peening apparatus in a comparative example.
Figure 11:
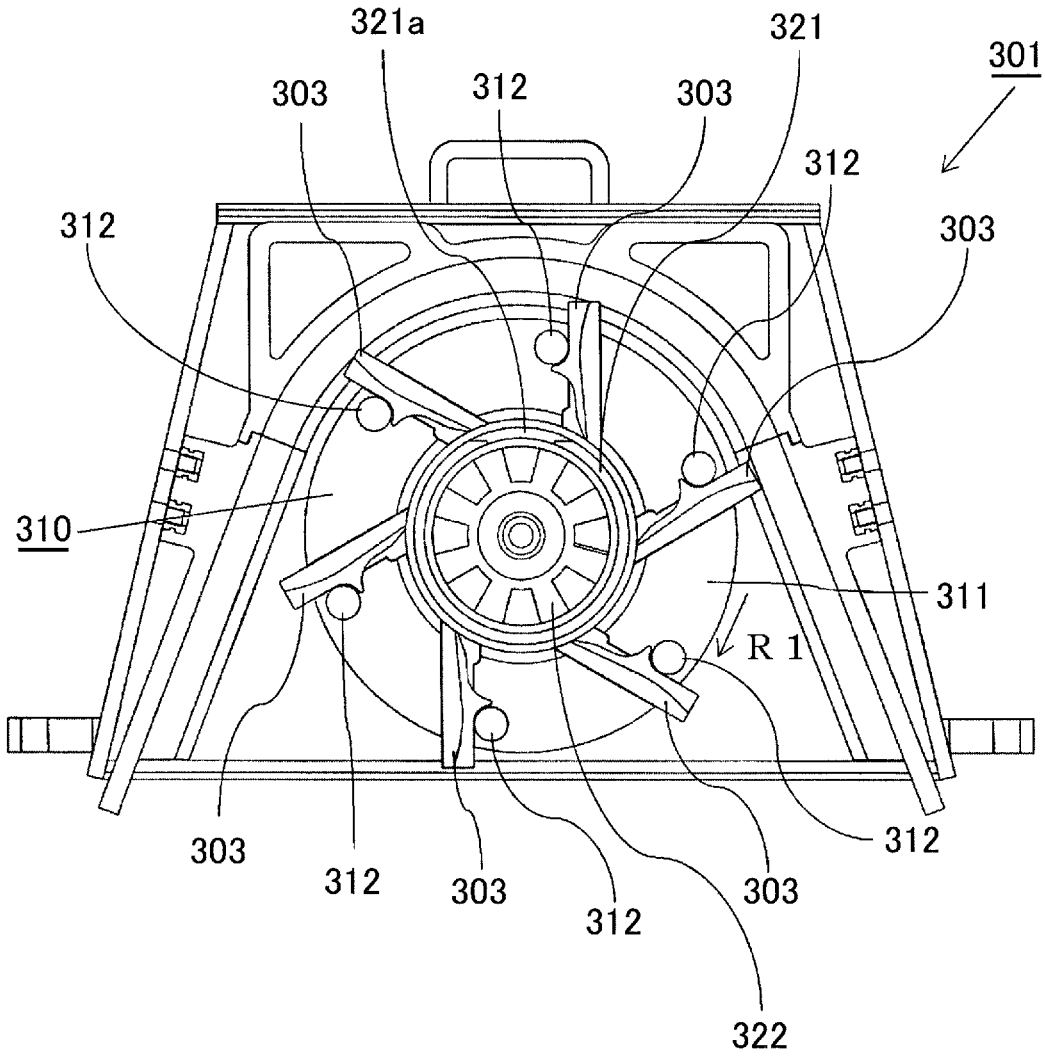
FIG. 11 is a front elevation cross sectional view showing a centrifugal projector alternatively used in an embodiment of the present invention.
Figure 12:
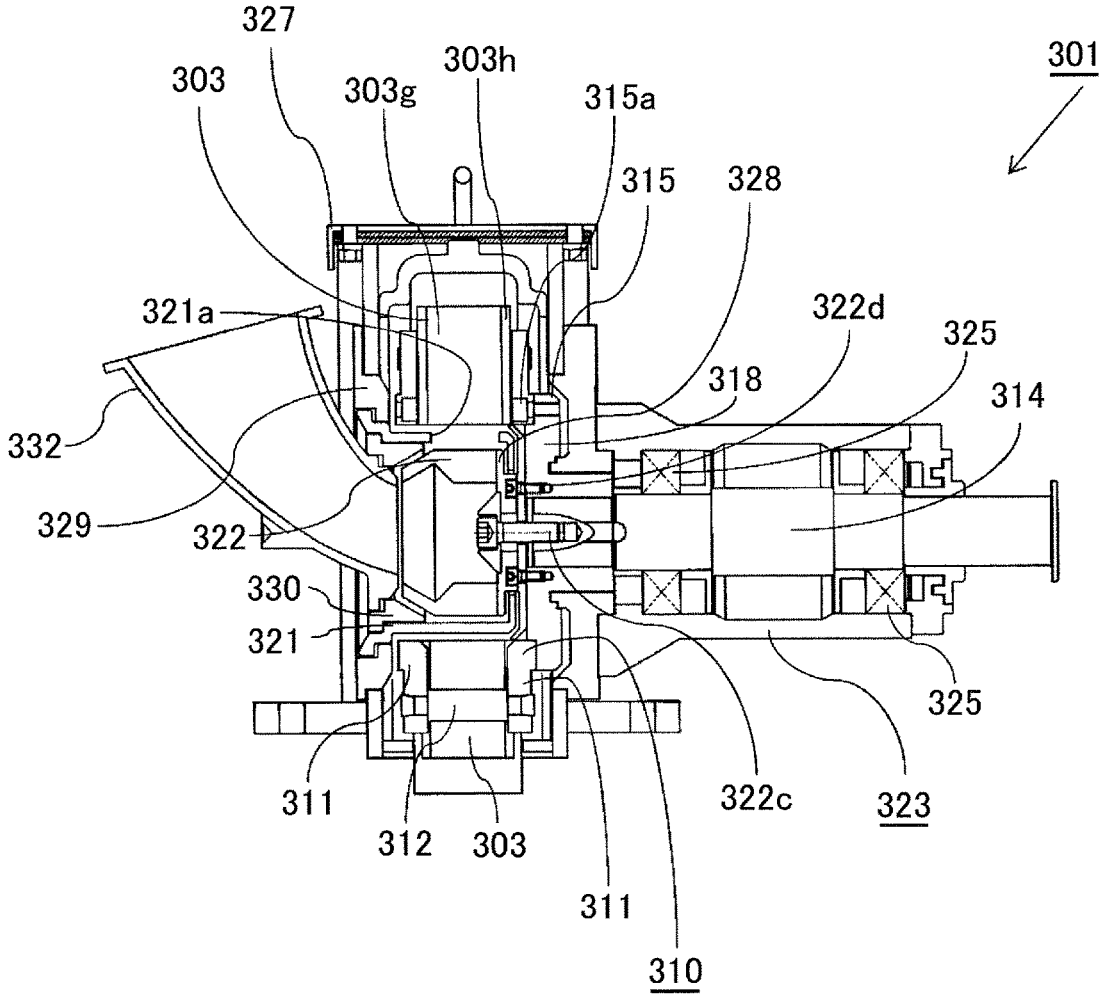
FIG. 12 is a side elevation cross sectional view of the centrifugal projector shown in FIG. 11.
Figures 13A, 13B, 13C, 13D, 13E, 13F:
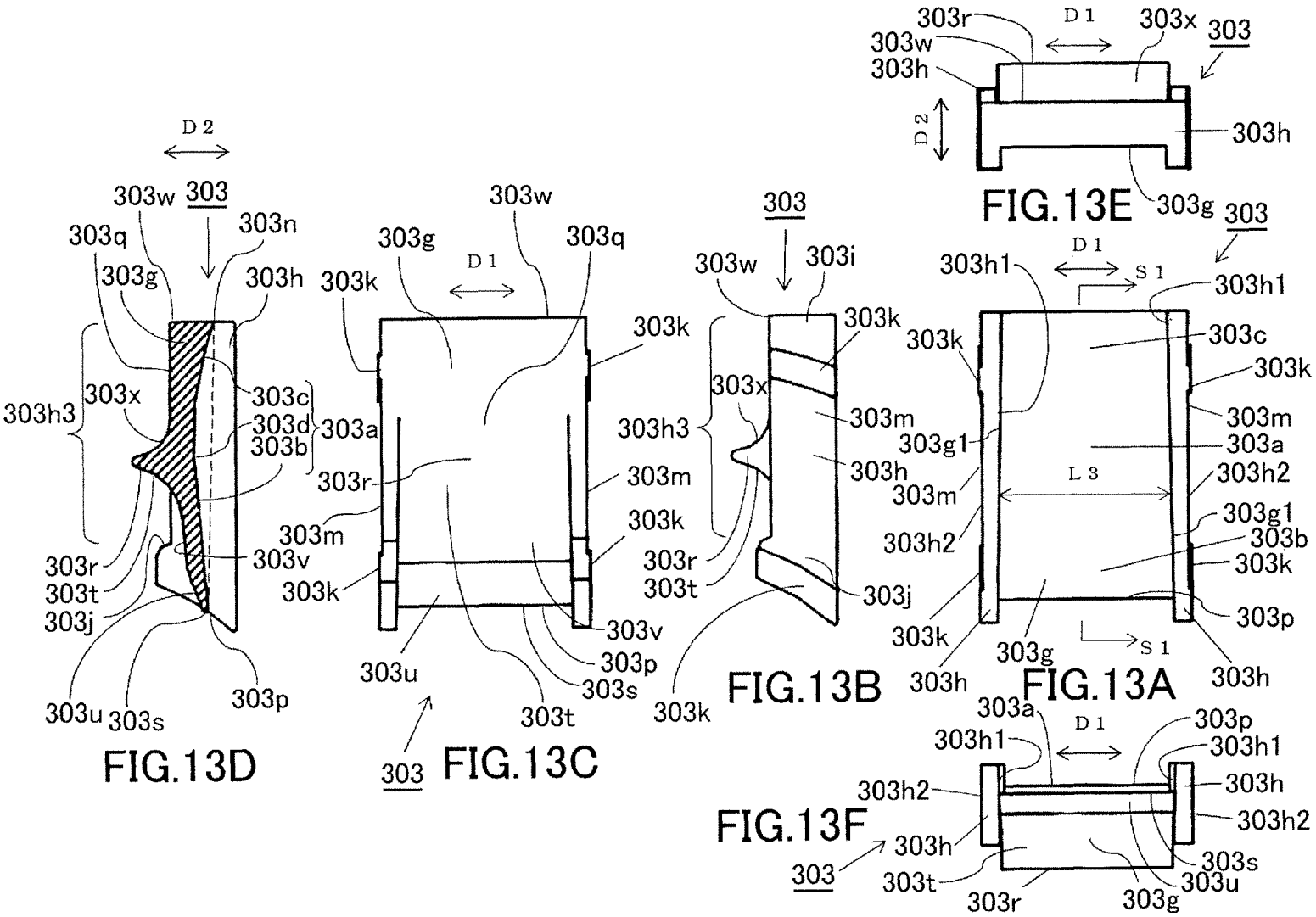
FIGS. 13A-13F are diagrams showing a blade in the centrifugal projector shown in FIG. 11.
Figure 14A:
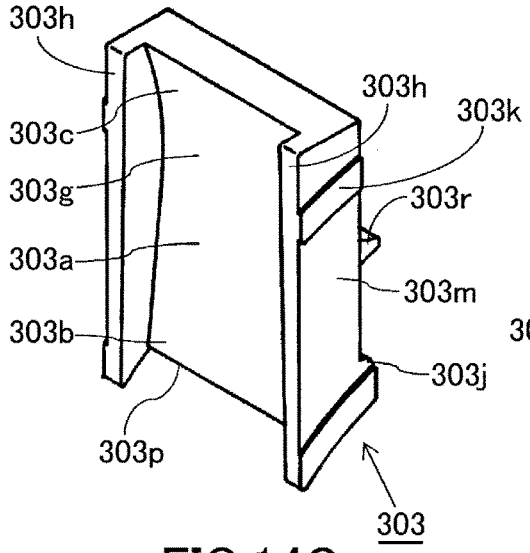
FIGS. 14A-14D are perspective views showing the blade shown in FIGS. 13A-13F.
Figure 14B:
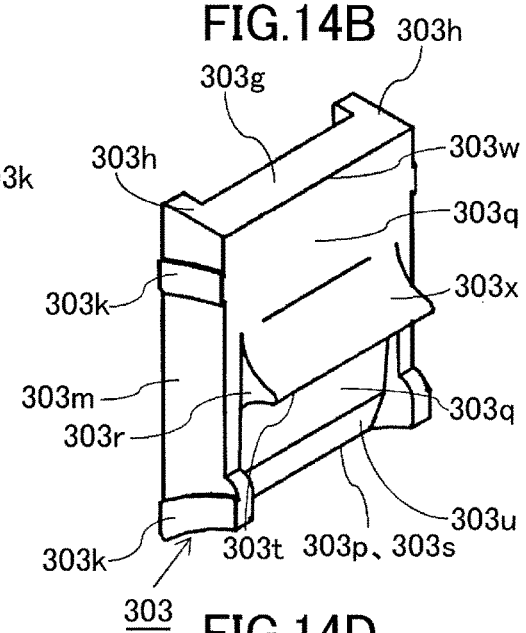
Figure 14C:
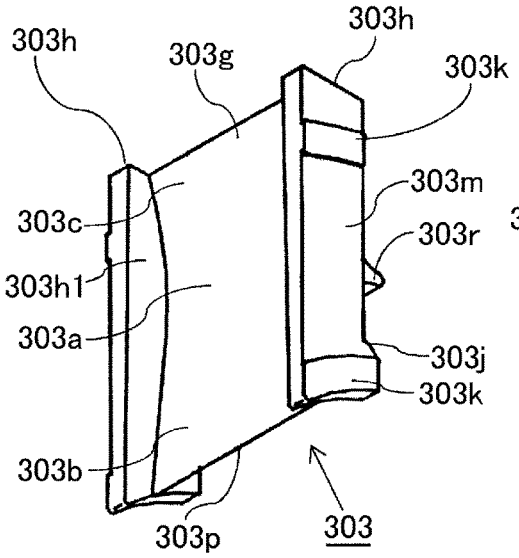
Figure 14D:
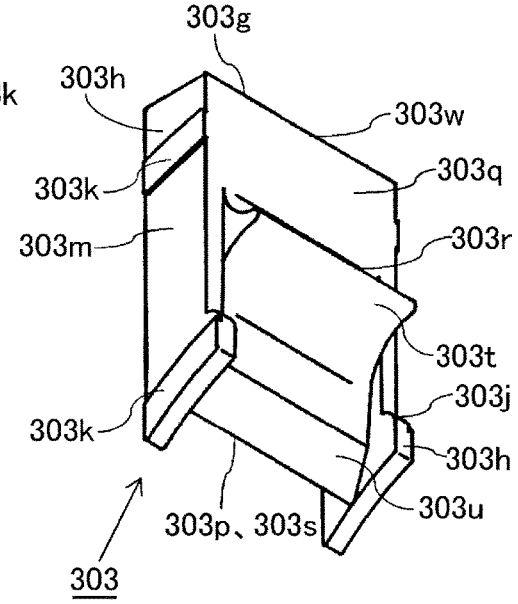

We now provide additional explanation of the operation and effect of the present embodiment through comparison with a comparative structure. FIG. 10 shows a shot peening apparatus 200 according to a comparative structure. Note that in FIG. 10 the same reference numerals are used for the same constituent parts as the present embodiment. In the shot peening apparatus 200, the surface of the blade wheel 204 blades facing in the rotational direction extends radially outward from the rotational center. Moreover, only one rectangular opening as seen from the side is through-formed on the control cage.

In the projector 202 of such a shot peening apparatus 200, because no rearward inclining portion is provided on the blade surface, projection of projection material discharged from the single opening has a large dispersion width in the workpiece W transport direction compared to the present embodiment. That is, the projection distribution curves k1, k2 for each projector 202 in this case have gradual rises at the base. In addition, only one rectangular opening as seen from the side is through-formed in each projector 202 control cage, therefore only a single projector peak can be formed by projection using a single projector 202.

The shot peening apparatus 200 comprises two projectors 202 disposed along the workpiece W transport direction (arrow D direction) on the upper side of the chain conveyor 20. The two projectors 202 are disposed so that the rotational center of the blade wheels 204 have the same orientation as the present embodiment, but the rotational directions of the blade wheels 204 are set to be mutually opposite. However when two projectors 202 are disposed, the apparatus as a whole increases in size. Moreover, it is difficult to form two separated projection peaks in the effective projection range of a single projector 202.

Against this, in the present embodiment as discussed above, two projection peaks P1, P2 can be set in an effective projection range using the single projector 40 shown in FIG. 9, and shot processing can be thoroughly performed over the entire circumference of the workpiece W spring wire. And, because there is no need to provide multiple projectors, the overall apparatus size can be reduced.

Also, in the present embodiment, as shown in FIG. 4, a rearward inclining portion 110 is formed on the base end side of the blades 104, and a non-rearward inclining portion 114 is formed on the tip portion side of the rearward inclining portion 110. Projection material gathered in the rearward inclining portion 110 is therefore projected after its speed is increased by the non-rearward inclining portion 114. Thus it is unnecessary to rotate the blade wheel 100 at a higher speed to raise the projection velocity, and energy consumption can be limited.

In the present embodiment the radial length of the rearward inclining portion 110 is set to be longer than the radial length of the non-rearward inclining portion 114. Therefore the velocity of projection material can be increased at the non-rearward inclining portion 114 after gathering sufficient projection material at the rearward inclining portion 110 of the blade 104.

In addition, in the present embodiment the rearward inclining portion 110 and the non-rearward inclining portion 114 are smoothly connected at the curved portion 112 of the surface 106 of the blade 104. Therefore after projection material has been gathered in the rearward inclining portion 110 of a blade 104, the projection material velocity can be gradually increased by the curved portion 112 and the non-rearward inclining portion 114.

As explained above, using the shot peening apparatus 10 of the present embodiment, surface treatment of a workpiece W such as a spring can be favorably performed by a single projector 40, and growth in the size of the apparatus can be constrained.

Without limitation to the embodiments of the present invention, various changes and variations are possible within the technical thinking set forth in the Claims.

For example, in the embodiments above the shot processing apparatus is a shot peening apparatus, but the shot processing apparatus may also be a shot blasting apparatus.

In the embodiments above the blade rearward inclining portion 110 inclines 40° to the rear side in the rotational direction relative to the radial direction of the blade wheel 100, and the sloping angle of the rearward inclining portion is preferably 30° to 50°, but other inclining angles such as 25° and 55° are also possible.

Also the non-rearward inclining portion inclines to the rear side in the rotational direction, but a configuration in which that inclining angle is smaller than the rearward inclining portion inclining angle and a configuration in which it inclines to the front side in the rotational direction relative to the radial direction are also acceptable. It is also acceptable not to provide a non-rearward inclining portion.

In cases such as when the blade wheel size is large, the radial length of the rearward inclining portion and the radial length of the non-rearward inclining portion maybe set to be equal. A configuration in which the rearward inclining portion and the non-rearward inclining portion are connected without mediation by a curved portion is also acceptable. A configuration in which no inclined portion 116 is formed on the base end portion of the reverse surface of the blades is also acceptable.

A configuration in which the blade wheel is attached to the rotary shaft of a drive motor through a hub is also acceptable. A configuration in which the projector 40 is disposed in a state in which the front and back orientations are the reverse of what is shown in FIG. 9 (so that the front side in the diagram becomes the back side) is also acceptable.

Note that the above embodiments and the aforementioned multiple variant examples may also be combined as appropriate.

For example, a centrifugal projector described below may be used in the above embodiments of the shot peening apparatus according to the present invention.

Below, referring to drawings, such centrifugal projector alternatively used in the above embodiments of the present invention will be explained. As shown in FIGS. 11 through 13A-13F, a centrifugal projector 301 used in an embodiment of the present invention comprises a plurality of blades 303; the blades 303 are rotated and projection material 302

("projection material" is also referred to below as "shot") is projected by centrifugal force.

As shown in FIGS. 13A-13F through 15A-15C, the projection surface 303*a* of each blade 303 has a first part 303*b* forming the radial inner part of the projection surface 303*a*, and a second part 303*c*, positioned radially outside the first part 303*b* and forming the outer part of the projection surface 303*a*. The second part 303*c* of the blade 303 is disposed as an integral part of the first part 303*b*, mediated by a bend or curved portion relative to the first part 303*b*. In the blade 303 explained here, the first part 303*b* and second part 303*c* are disposed through a curved portion 303*d*. The shape explained here is the shape of a cross section perpendicular to the rotary shaft of the blade 303.

Figures 15A, 15B, 15C:
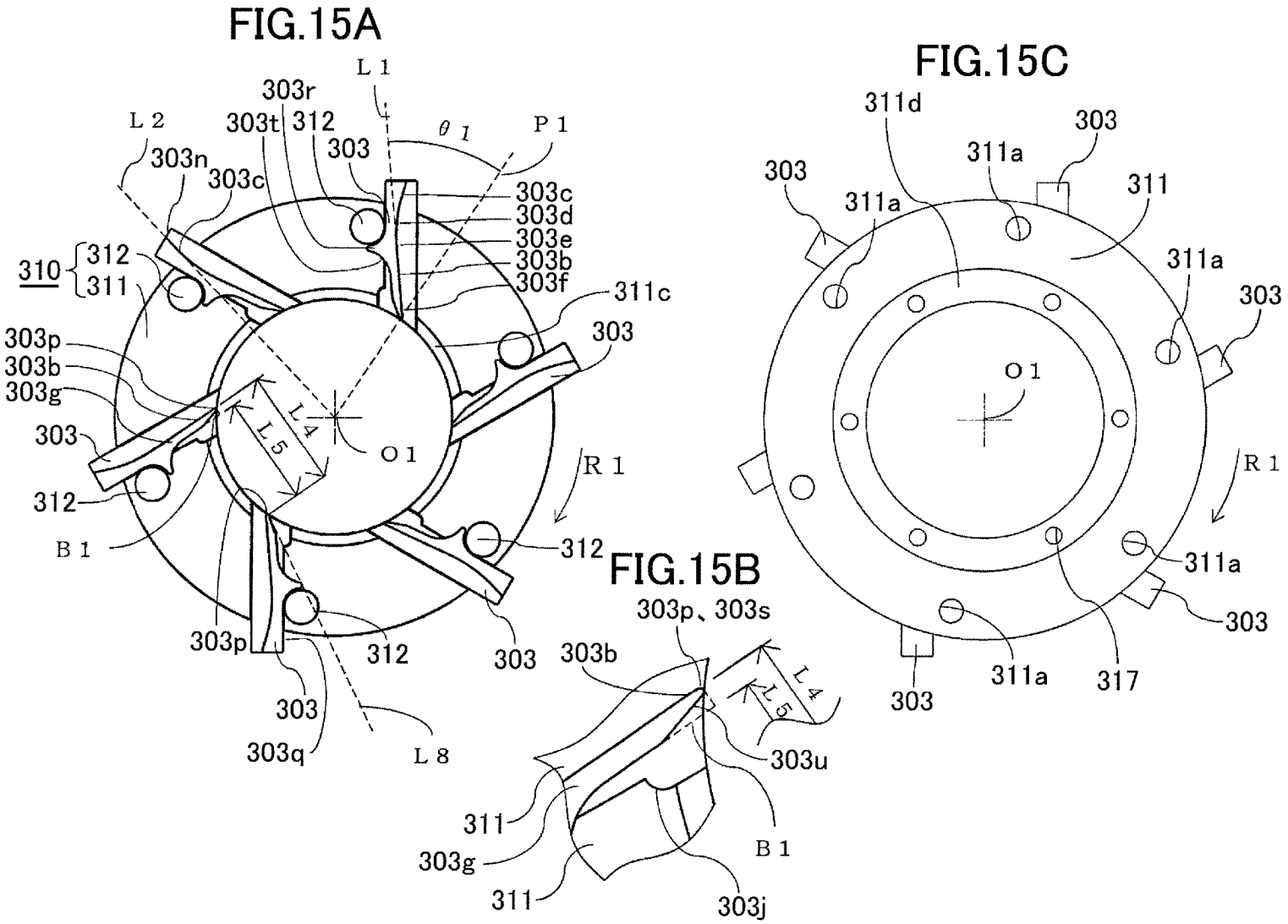
FIGS. 15A-15C are diagrams showing the blade and the side plate unit of the centrifugal projector shown in FIG. 11.

As shown in FIGS. 15A-15C, the outer side 303*e* of the first part 303*b* of the blade 303 is formed so that its outer side 303*e* inclines to rear side of the rotational direction R1 with respect with respect to the inner side 303*f*. The rotational direction R1 is the direction of rotation of the blade 303 and the side plate unit 310, etc., described below. In other words, the first part 303*b* of the blade 303 inclines relative to the line which includes the rotational center (the normal line). Note that the first part 303*b* of the blade 303 is formed in a straight line, but may also be a curved shape. However, a straight line shape is advantageous from the standpoint of the shot-concentrating function, and for manufacturing.

The second part 303*c* of the blade 303 is formed to be positioned more to the front side of the rotational direction R1 than the imaginary line L1, which extends the first part 303*b* outward. Note that the second part 303*c* of the blade 303 is formed with a curved shape, but may also be formed in a straight line. However, from the standpoint of the shot acceleration function described below and for manufacturing, a curved shape is advantageous. Also, in blade 303 the curved portion 303*d* is integrally formed as a single piece with the curved shape of the second part 303*c*, but blade 303 is not limited thereto.

As described above, the first part 303*b* of the blade 303 is rearwardly inclined in the rotational direction, so projection material can be concentrated. For the inclined angle θ1 of the first part 303*b* of the blade 303, an angle of 30° to 50° has a favorable effect, as described below (see FIGS. 15A-15C). Here "inclined angle" means the angle relative to plane P1, which includes the rotary shaft of blade 303. In the figure, O1 indicates the rotational center (rotary shaft of blade 303). Also, because the first part 303*b* of the blade 303 is formed at a pitch, projection speed of the projection material is decreased, but this can be compensated by the second part 303*c* function of accelerating projection material; i.e., a drop in projection speed of the blade 303 can be prevented, and projection speed maintained. Note that because the second part 303*c* of the blade 303 is formed to be positioned more to the rotational direction R1 front side than imaginary line L1, which extends the first part 303*b* outward, projection material can be accelerated by the second part 303*c*. Hence the blade 303, by means of the first part 303*b* and second part 303*c*, can concentrate projection pattern of the projection material without decreasing the projection material speed, and projection efficiency can be increased.

Also, as shown in FIGS. 13A-13F, each blade 303 has a blade projection portion 303*g* with a projection surface 303*a* for projecting projection material, and a pair of attachment portions 303*h* positioned on both edge portions of the blade projection portion 303*g*. Here, assuming the direction parallel to the axial direction of the rotary shaft of the blade 303 is first direction D1, the attachment portions 303*h* are respectively disposed on both edges of first direction D1 of the blade projection portion 303*g*. These attachment portions 303*h* are formed to have a greater thickness than the thickness of the blade projection portion 303*g* (the thickness in thickness direction of the blade projection portion 303*g* (e.g., second direction D2)), and are integrated with this blade projection portion 303*g* (see FIGS. 13D and 13E. Note that the second direction D2 is perpendicular to the first direction D1 in the top view (plan view) shown in FIGS. 13A-13F.

Also, the attachment portions 303*h* of the blade 303 are formed so that at least the plane of the outside part 303*i* thereof perpendicular to the direction of the rotary shaft forms a straight shape. That is, the blade projection portion 303*g* has a curved or bent shape as described above, but the majority of the outside part of the attachment portions 303*h* (the majority of the parts other than the inside parts described below) are straight shapes without curves or bends. In FIGS. 13A-13F, reference numeral 303*h*3 indicates the part formed in a straight shape on the attachment portions 303*h*.

As described above, the attachment portions 303*h* of the blade 303 are given a straight shape, facilitating the work described below of attaching to the side plate unit 310, the work of removing from the side plate unit 310, and so forth. Thus, in blade 303, changing operation of a blade projection portion 303*g*, (blade 303) comprising a first part 303*b* and second part 303*c* for increasing projection efficiency as described above, relative to the side plate unit 310, can be easily accomplished.

Also, the attaching portions 303*h* of the blade 303 have a locking portion 303*j* on the radial inside part. The shape of the locking portion 303*j* in the plane perpendicular to the rotary shaft direction of the blade 303 is formed to project from the straight shape described above (see FIGS. 13B and 13D). Moreover, a plurality of contacting portions 303*k* (two each here) are disposed on the outside in the direction D1 of the pair of attachment portions 303*h*. The contacting portions 303*k* are formed to project from the outside surface 303*m* of the attachment portions 303*h*. With the blade attached to the side plate unit 310, the contacting portions 303*k* are made to contact the channel portion (guide channel portion 313) disposed on the side plate 311, and are attached at an appropriate position.

The blade 303 has a locking portion 303*j*, enabling accurate attachment to a predetermined position on the side plate unit 310 so that favorable projection performance can be achieved. Also, by bringing the contacting portions 303*k* into contact with the channel portion without the outside surface 303*m* of the attachment portions 303*h* of blade 303 directly contacting the channel portion of the side plate 311, the blade 303 can be smoothly attached when attaching it to the side plate unit 310.

The blade projection portion 303*g* and attachment portions 303*h* are formed so that the spacing L3 of the inside surfaces 303*h*1 opposing the pair of attachment portions 303*h* becomes gradually smaller toward the outside with respect to the inside in the radial direction. That is, the opposing inside surfaces 303*h*1 on the pair of attachment portions 303*h* are slightly inclined. In other words, the inside surfaces 303*h*1 are mutually inclined, and are also inclined relative to the outside surfaces 303*h*2. The outside surfaces 303*h*2 on the pair of attachment portions 303*h* are essentially parallel. The outside surfaces 303*h*2 are parallel to the main surface of the side plate 311. The spacing L3 between the two edge portions 303*g*1 in the front elevation shown in FIG. 13A of the blade projection portion 303*g*, i.e., the spacing L3 in the first direction D1 of the two edge portions 303g1, is formed to become gradually smaller toward the outside with respect to the inside in the radial direction.

Since the blade 303 thus has a blade projection portion 303g and attachment portions 303h, widening of the grouped projection material in the first direction D1 toward the radial outward direction within the centrifugal projector 301 can be prevented. That is, the blade 303 contributes to the concentration of the projection material projection pattern, and has good compatibility with the above-described shapes of the first part 303b and second part 303c, so that the projection pattern can be concentrated by a synergistic effect. Note also that in the blade of the present invention the inside surfaces 303h1 and two edge portions 303g1 are not limited to being inclined; even if parallel, the other effects are present.

Also, the second part 303c of the blade 303 is formed so that an imaginary line connecting the rotational center of the blade 303 to a point close to the outside end portion of the second part 303c matches the normal line, so the above-described projection material accelerating function can be achieved. Here the imaginary line L2 connecting the blade 303 rotational center to the second part 303c outside end portion 303n is formed to match the normal line (see FIG. 15A, etc.).

In the second part 303c of the blade 303 constituted as described above, the projection material projection speed can be essentially the same as the projection speed when there is a flat projection surface formed to match the normal line. That is, the blade 303 can concentrate the projection pattern without decreasing the projection speed, so that projection efficiency can be increased.

Note that in blade 303, the imaginary line L2 is formed to match the normal line to achieve essentially the same speed as the projection speed when there is a flat projection surface, but the blade 303 is not limited thereto. That is, from the standpoint of achieving the acceleration function, the imaginary line L2 can also incline forward in the rotational direction more than the normal line in the blade 303. In other words, the imaginary line connecting the blade 303 rotational center O1 to the radial inner side from the second part 303c outside end portion can be formed to match the normal line.

The end portion 303p of the blade projection portion 303g is formed in a shape which tapers toward the inside, and by enlarging the distance between the inside end portions 303p on each blade can function as a guide portion for increasing the amount of projection material guided between each of the rotating blades 303. That is, the end portions 303p as guide portions increase the amount of projection material guided between each of the blades 303. In other words, when an end portion is not formed in a tapered shape (the case shown by the dotted line B1 in FIGS. 15A and 15B), projection material colliding with that part bounces back, but when an end portion 303p formed in a tapered shape is adopted, the blade end portion does not interfere, and projection material enters in, increasing the amount of projection material guided between each of the blades 303.

As described below, the present inventors conducted repeated simulations and experiments, but came to understand that when the inside end portion of a blade projection portion 303g is formed to be thick, and the end portion on the inside of the blade projection portion 303g is not formed to be thick (the case shown by dotted line B1 in FIGS. 15A and 15B), projection material bounces back toward the center in that part (the end portion part on the thick inside). By forming the blade projection portion 303g inside end portion 303p in a tapered shape, as in the blade 303 described above, the distance L4 between the end portions 303p on the inside of the blade 303 can be enlarged. That is, the distance L4 can be made large with respect to the distance L5 between the end portions in the case shown by dotted line B1. The dotted line B1 indicates a comparative example relative to the tapered shape. As shown by the distance L4, the amount of projection material introduced between the rotating blades 303 can be increased using a tapered shape. In addition, bounce back of projection material toward the center can be reduced. Hence a favorable projection pattern can be achieved.

The blade projection portion 303g has a raised portion 303r formed on a projection back surface 303q disposed on the opposite side to the projection surface 303a. The blade projection portion 303g has a curved surface 303t disposed between the raised portion 303r and an end portion 303s on the blade projection portion 303g. Note that here a curved surface 303t is formed starting from the end portion 303s on the projection back surface 303q, mediated by the taper-forming portion 303u and the planar portion 303v. The taper-forming portion 303u forms the above-described first part 303b and the above-described tapered end portion 303p. Also, a curved surface 303x is formed between raised portion 303r and outside end portion 303w in the blade projection portion 303g. As described below, a side plate unit 310 connecting member 312 can be disposed on this curved surface 303x. Note that the taper-forming portion 303u was formed in a planar shape here, but may also be formed in a curved shape, and furthermore may be formed as part of the curved surface 303t, without going through the planar portion 303v.

The above-described curved surface 303t on the radial inside of the blade 303 enables the projection material 302 to be smoothly guided to the projection surface 303a side of the next blade 303 (the next blade 303 to come around in rotation). This enables a connecting member (stay bolt) 312 to be disposed on the reverse side of the raised portion 303r on which the curved surface 303t is formed, so that a return toward the center (rotational center of blade 303) of projection material which has hit the connecting member (stay bolt) 312 can be prevented. Hence a centrifugal projector 301 comprising this blade 303 and side plate unit 310 can produce a favorable projection pattern.

As shown in FIGS. 15A-15C and 16A-16B, a centrifugal projector 301 alternatively used in an embodiment of the present invention comprises a side plate unit 310 for attaching the above-described plurality of blades 303. The side plate unit 310 has a pair of side plates 311 and a connecting member 312 for connecting this pair of side plates 311 at a predetermined separation distance. The connecting member 312 is inserted into a hole 311a formed in the pair of side plates 311 and fixed. It is fixed, for example, by swaging or screwing. The connecting member 312 is a member referred to, for example, as a stay bolt.

A guide channel portion 313 is formed in the surfaces 311b mutually facing the pair of side plates 311. Also, the pair of side plates 311 is a donut-shaped (ring-shaped) member, and a taper portion 311c is disposed on the inside of the mutually opposing surfaces 311b. The guide channel portion 313 is formed at a pitch so as to be positioned on the rotational direction rear side with respect to the outer side 313a and inner side 313b thereof. The shape explained here is the shape in the cross section perpendicular to the rotary shaft (rotational center) of the blade 303 and the side plate unit 310. Note that the guide channel portion 313 corresponds to the attachment portions 303h of the blade 303; the attachment portions 303*h* of the blade 303 are slid in and inserted to attach the blade 303 to the side plate unit 310.

In such a side plate unit 310, the blades 303 can be reliably attached while demonstrating their performance in concentrating the projection pattern as described above. Blades 303 can also be easily replaced.

In the guide channel portion 313 of the side plates 311 on the side plate unit 310, at least the outside part 313*c* thereof is formed in a straight shape. Also, in the guide channel portion 313 the inside part 313*d* is formed to have a broader width than the straight shape. The inside part 313*d* of the guide channel portion 313 locks to the locking portion 303*j* on the attachment portions 303*h* of the blade 303 and regulates the position of the blade 303 (attachment portions 303*h*). The outside part 313*c* shows the part of the guide channel portion 313 formed in a straight shape. This guide channel portion 313 outside part 313*c* corresponds to the straight shaped part 303*h*3 of the attachment portions 303*h*. The imaginary center line L6 of the straight-shaped part 313*c* is tilted in the rotational rear direction (see FIGS. 16A-16B). The inclined angle θ2 is set at an angle close to the blade tilt angle, for which an angle of 30° to 50° is favorably effective. Here "inclined angle" means the angle relative to plane P2, which includes the rotary shaft of blade 303.

Since the guide outside part 313*c* of the channel portion 313 on the side plates 311 is given a straight shape, blades 303 can be easily replaced. That is, the blades 303, which implement the functions of concentrating and accelerating projection material, can be appropriately attached. In other words, while the first part 303*b* and second part 303*c* are formed on the projection surface 303*a* of the blade projection portion 303*g* as described above, the attachment portions 303*h* and guide channel portion 313 have a straight shape, therefore the blades 303 can be attached and removed in a simple and smooth manner.

Also, the locking portion 303*j* of the attachment portions 303*h* on the blade 303 can lock to the inside part 313*d* of the guide channel portion 313 on the side plates 311, therefore the blades 303 can be fixed at an appropriate position.

The connecting members 312 on the side plate unit 310 are provided in the same number as the number of blades 303. Each connecting member 312 is positioned between the blades 303. In addition, connecting members 312 are disposed at positions closer to the projection back surface 303*q* than the midway position between the blade 303 projection surface 303*a* and the projection back surface 303*q* on adjacent blades 303. Note that to obtain the midway position, a calculation is made of an imaginary arc L7 passing through the center position of the connecting member 312, and of intersections K1, K2 with the above-described imaginary line L6, centered on O1 (see FIGS. 16A-16B). It is sufficient to be on the imaginary arc L7, and to designate the point K3 positioned midway between these intersections K1, K2 as the "midway position." In such cases, the connecting member 312 is positioned on the projection back surface 303*q* side of the midway position K3. The "midway position" is not limited to this; it is also possible to calculate the intersection between the arc L7 and the projection surface 303*a* and the intersection between the arc L7 and the projection back surface 303*q* and use a point positioned on the arc L7 and between these intersections.

As shown in FIGS. 15A-15C, in a cross section within a plane perpendicular to the direction of the rotary shaft, the imaginary line connecting from the tip of the end portion 303*p* inside the blade projection portion 303*g* so as to contact the raised portion 303*r* formed on the projection back surface of the blade projection portion 303*g* (contact close to the peak of the raised portion 303*r*) is deemed to be imaginary line L8. Relative to this imaginary line L8, a favorable projection pattern can be formed by disposing the connecting member 312 in a position where the connecting member 312 is close to the blade 303 projection back surface 303*q*, so that at least a part of the cross section of the connecting member 312 is positioned on the projection back surface 303*q* side of the blade 303. Here, furthermore, the connecting member 312 is disposed in a position close to the projection back surface 303*q* of the blade 303 so that, relative to this imaginary line L8, the surface area of the cross section in the part on the side of the projection back surface 303*q* of the blade 303 is half or more of the cross section of the connecting member 312, therefore a favorable projection pattern can be formed.

The side plate unit 310 thus constituted prevents projection material which has collided with the connecting member (stay bolt) 312 from returning to the center side. Hence a centrifugal projector 301 comprising this blade 303 and the side plate unit 310 can produce a favorable projection pattern.

The number of the above-described blades 303 is six. This means that with respect to cases in which 308 or 312 units are provided, the distance between the end portions on the inside between each blade can be increased, and bounce back of projection material toward the center at the end portions of each blade can be reduced; i.e., the projection pattern can be improved. This is also just right when considering the same number of connecting members (stay bolts). In other words, the same number of connecting members 312 were provided as for the blades 303 described above, but if the number of connecting members 312 becomes excessive, the potential increases for projection material which has bounced back at the connecting members to return to the center side. On the other hand if six blades and connecting members are provided, the effect of the connecting members can be reduced and a favorable projection pattern achieved. If the number is reduced too much, for example to four, blade friction becomes a problem, and the frequency of blade replacement increases, along with maintenance person hours. Increases in the time difference in projection material (projection material supplied from the control cage opening window 321*a* described below) supplied to each blade leads to the problem of increased blade size in the radial direction, and increased blade weight. In light of the above, 306 to 308 blades is an appropriate number, and 306 is the optimal number in the present invention.

Figure 16B:
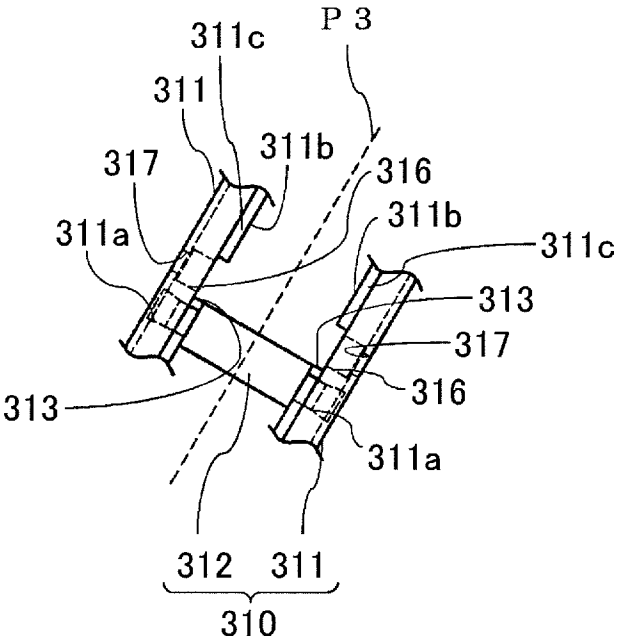
FIGS. 16A-16B are diagrams showing the side plate unit shown in FIGS. 15A-15C.
Figure 16A:
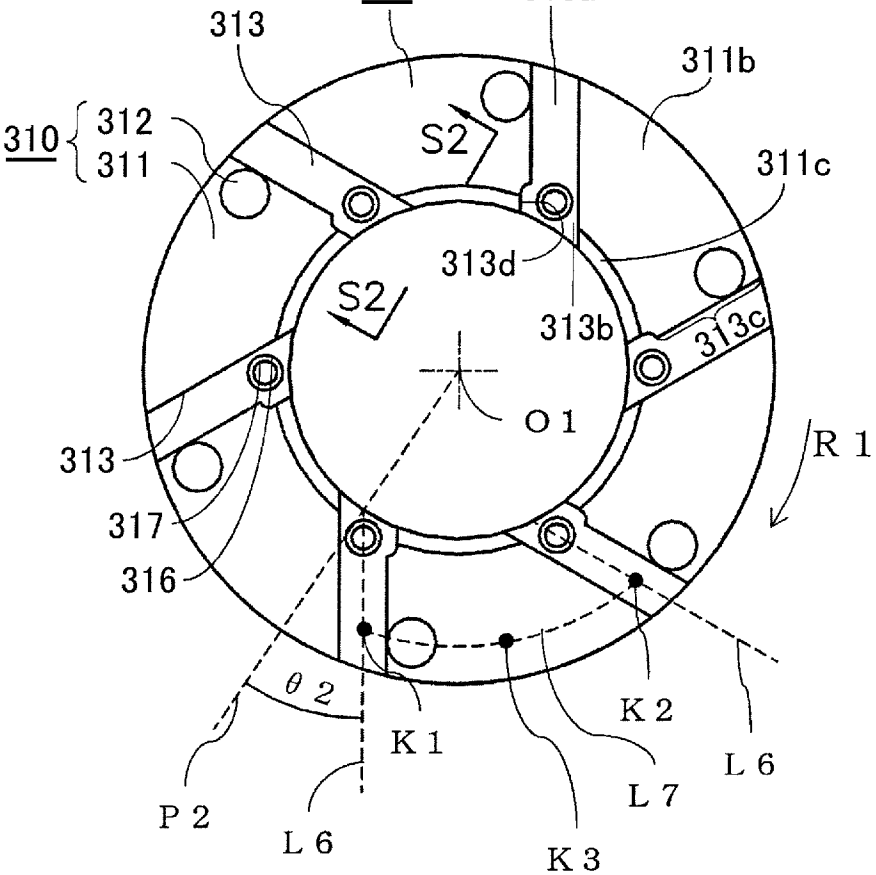
Figure 17:
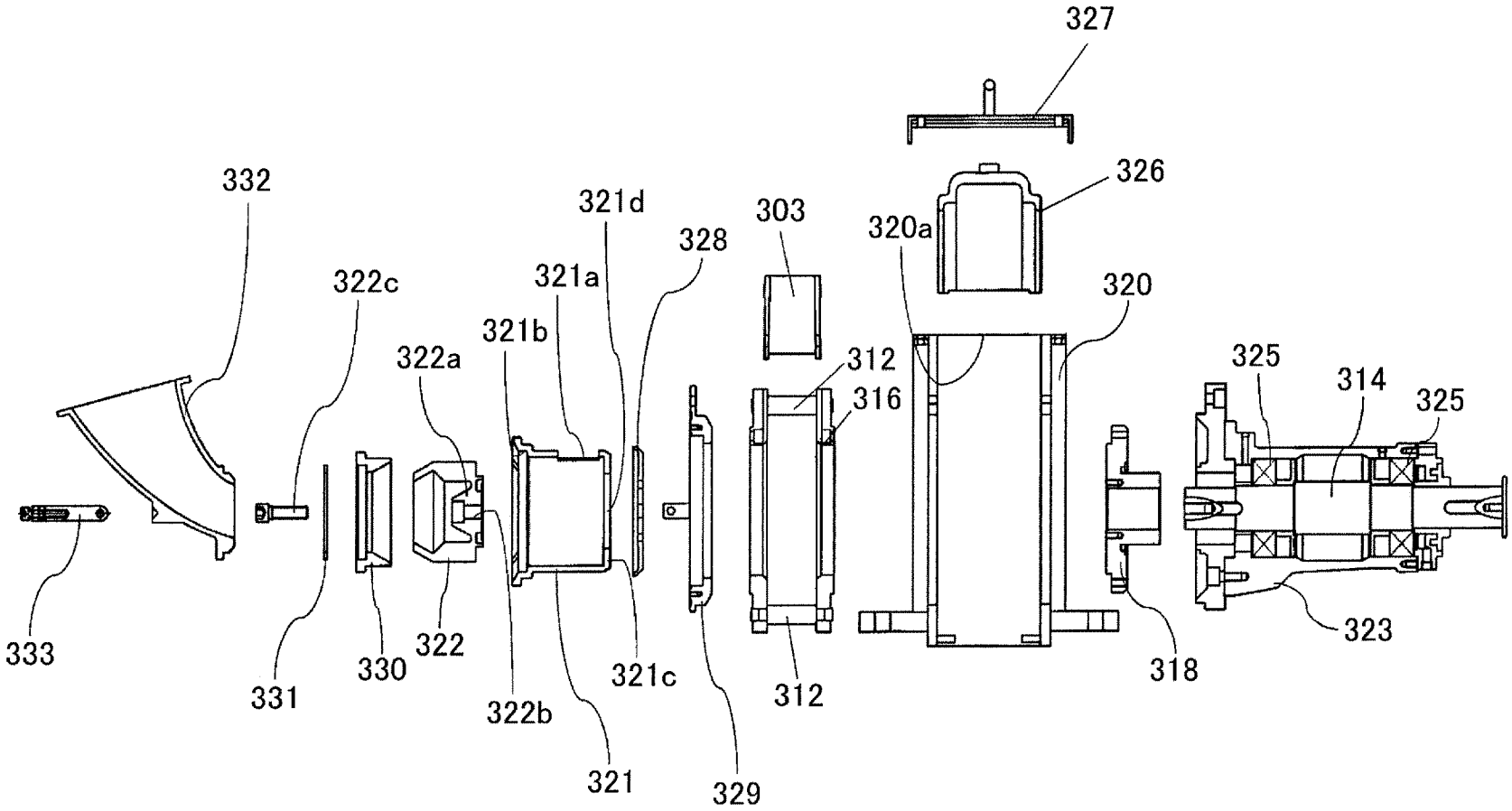
FIG. 17 is a component exploded view showing the separate major parts of the centrifugal projector shown in FIG. 12.
Figure 18A:
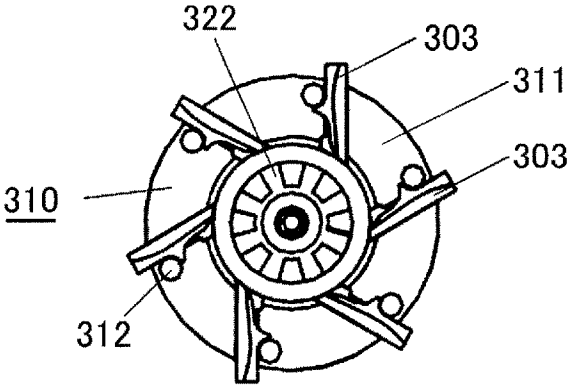
FIGS. 18A-18B are diagrams showing the major parts, partially separated, of the centrifugal projector shown in FIG. 11.
Figure 18B:
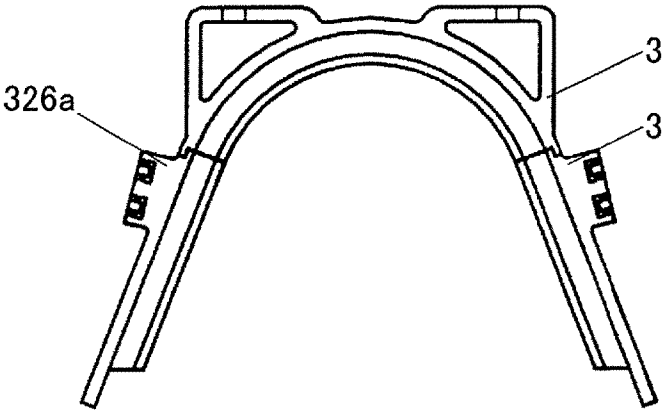
Figure 18C:
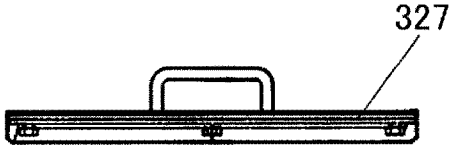
FIG. 18C is a cross sectional view of a lid.
Figure 18D:
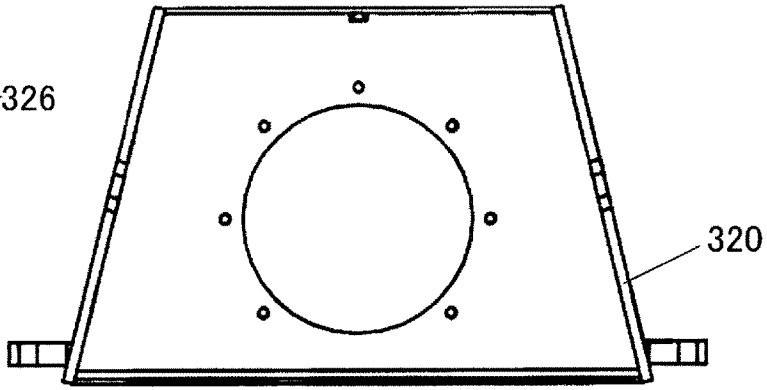
FIG. 18D is a cross sectional view of a main unit case.
Figures 19A, 19B, 19C, 19D, 19E, 19F, 19G, 19H, 19I, 19J, 19K, 19L, 19M, 19N:
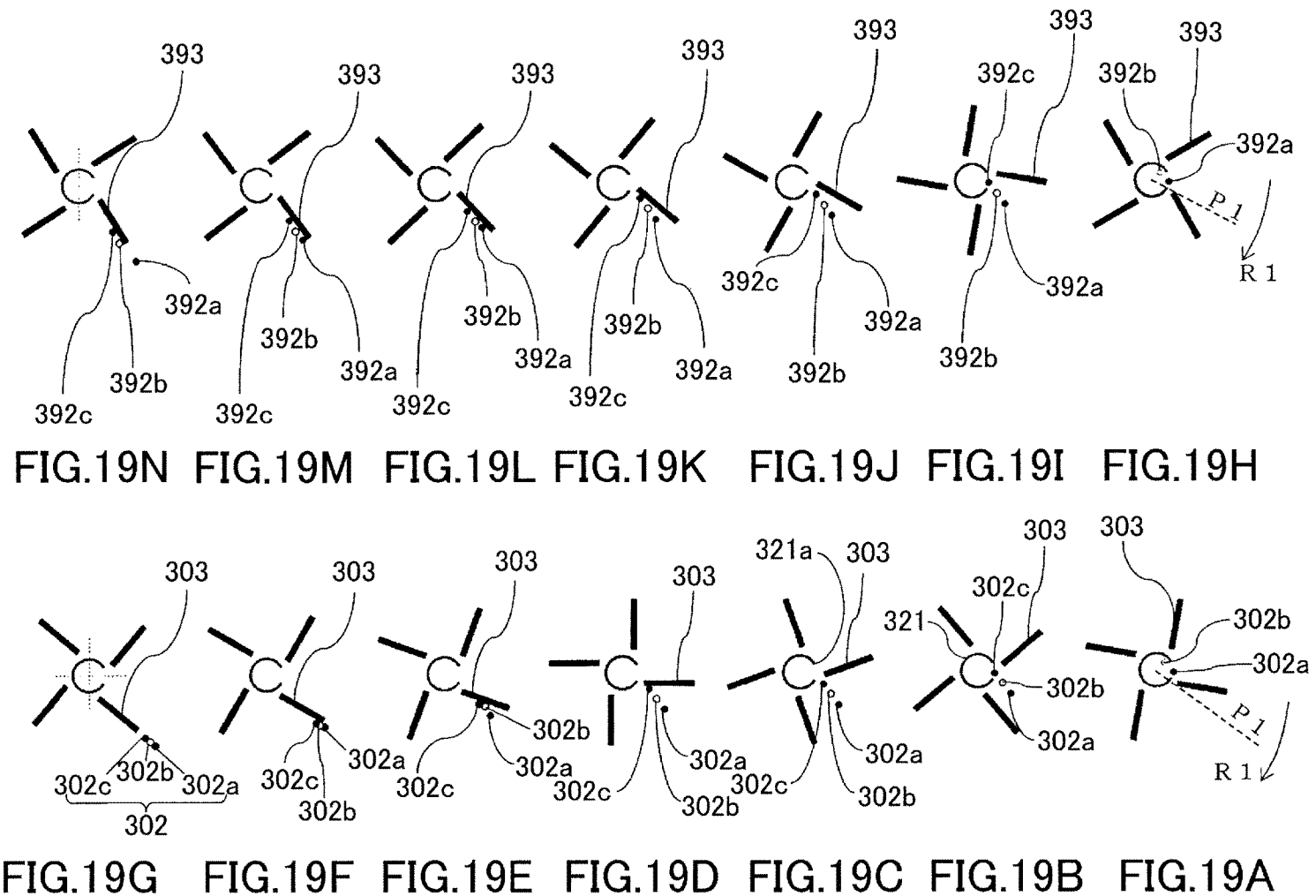
Figures 20A, 20B, 20C, 20D, 20E, 20F:
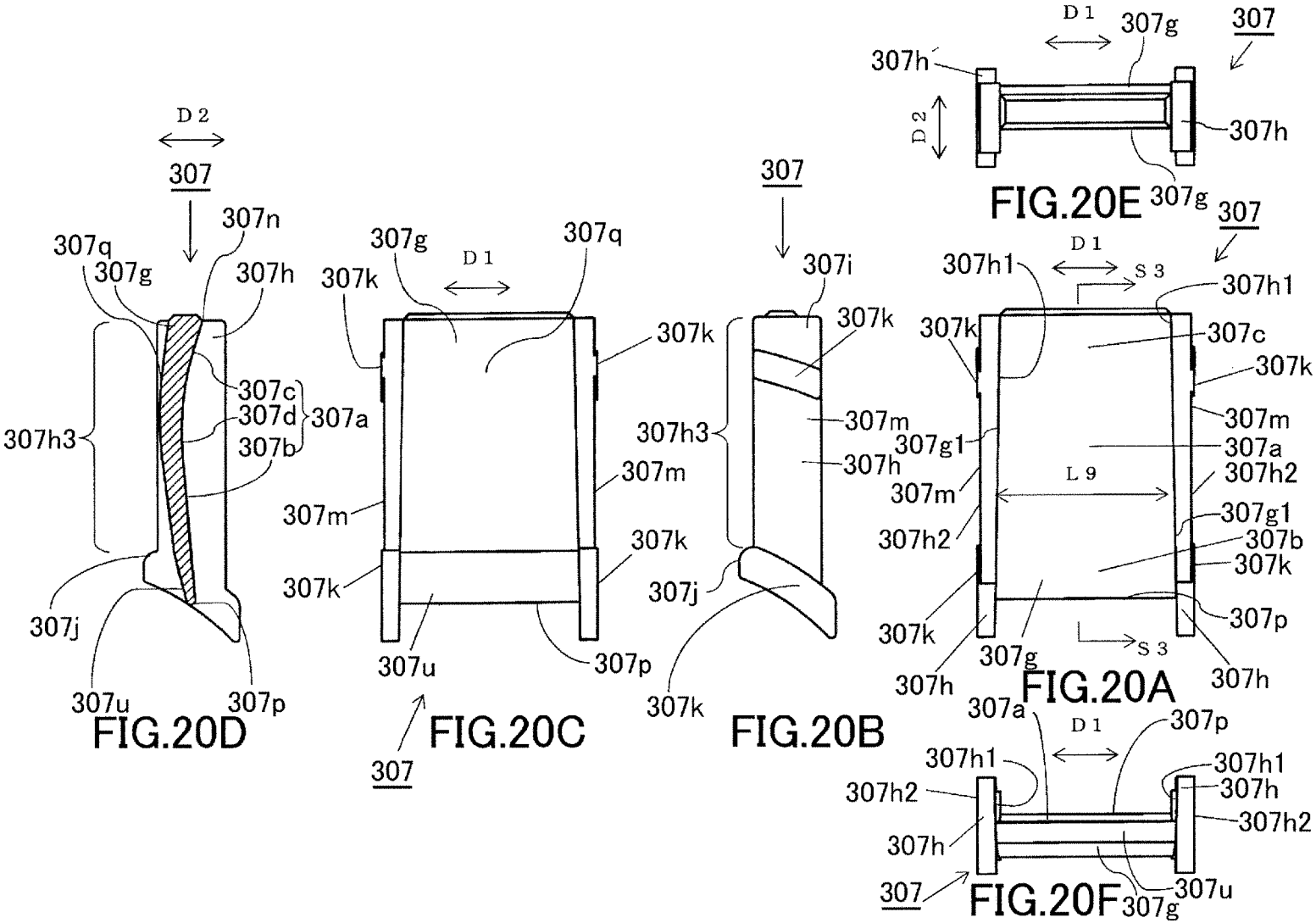
FIGS. 20A-20F are diagrams showing another example of a blade which can be used in a centrifugal projector according to an embodiment of the present invention.
Figure 21A:
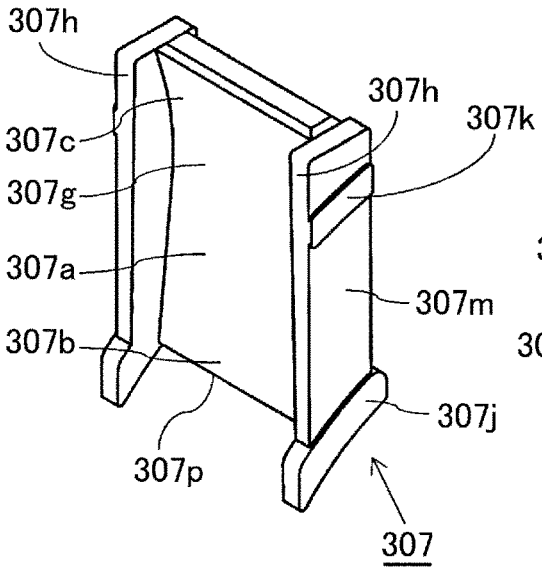
FIGS. 21A-21D are perspective views showing the blade shown in FIGS. 20A-20F.
Figure 21B:
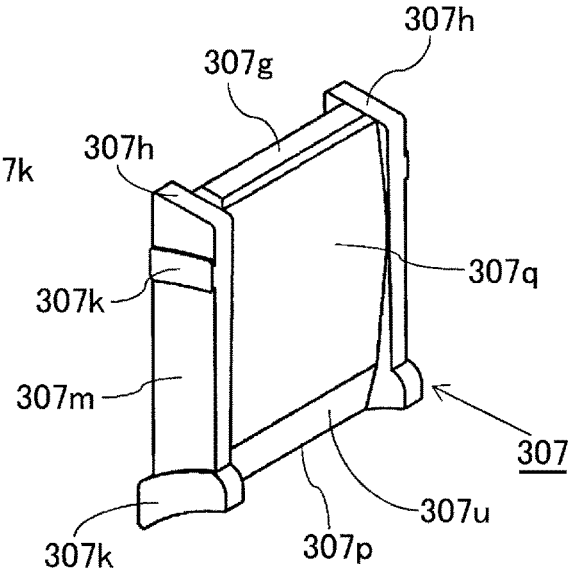
Figure 21C:
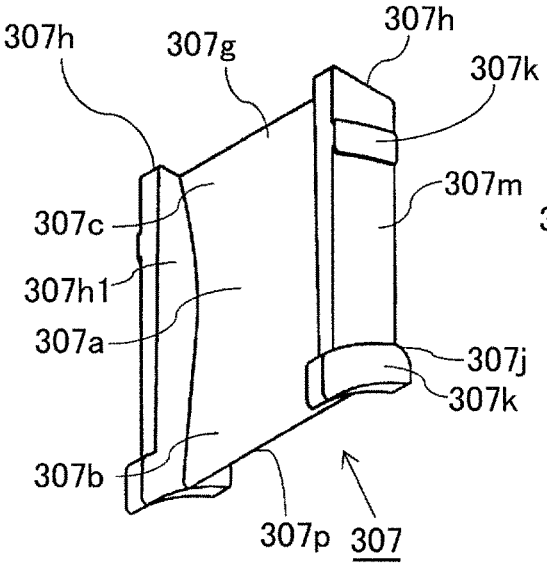
Figure 21D:
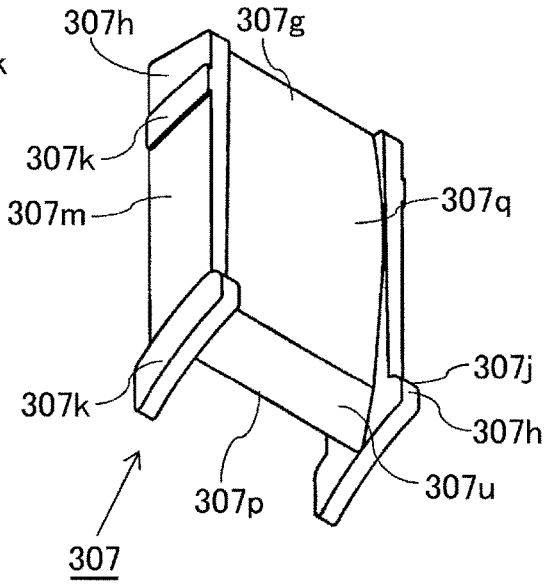

As shown in FIGS. 16A-16B, a recessed portion 316 for attaching a bolt 315 to fix the side plate unit 310 to the rotary drive side is provided on the guide channel portion 313 of the side plates 311. Rotary drive side here means the hub 318 fixed to the rotary shaft 314 rotated in the rotary drive section (see FIGS. 12 and 17). An insertion hole 317 into which the bolt 315 is inserted is formed in this recessed portion 316. On the pair of side plates 311, a thick portion 311*d* is formed on the inside perimeter portion of the surface (outside surface) on the opposite side of mutually opposing surfaces, and the insertion hole 317 is positioned on the thick portion 311*d*.

The recessed portion 316 and insertion hole 317 are provided in the side plates 311, therefore fixing to and removal from the rotary shaft 314 side (hub 318) of the side plate unit 310 can be performed from the side plate unit 310, i.e., in the main unit case 320. By providing a recessed portion 316 for attaching a bolt 315 to the guide channel portion 313, the bolt 315 head portions 315*a* are hidden by the attachment portions 303*h* on the blade 303 after attachment of the blades 303 to the guide channel portion 313 of the side plate unit 310. As a result, the bolt 315 head portion 315*a* is not abraded. Also, fixing to and removal from the side plate unit 310 rotary driver side (rotary shaft 314, hub 318) can be performed from the side plate unit 310 side. Attachment of the side plate unit 310 to the hub 318, which is on the rotary drive side, was conventionally frequently done from the hub 318 (rotary shaft side), which was inconvenient. Here, because fixing of the side plate unit 310 rotary drive side can be performed from the side plate unit 310 side, attaching work is eased and convenience improved.

The pair of side plates 311 is formed to be plane-symmetrical relative to the imaginary plane P3 perpendicular to the connecting member 312 (see FIG. 16B). That is, the above-described recessed portion 316 and an insertion hole 317 for attaching the bolt 315 are placed on both of the pair of side plates 311. By changing the side of attachment of the pair of side plates 311 to the hub 318, the orientation of the guide channel portion 313 changes to the opposite side, and the orientation of the blades 303 changes to the opposite side. This enables reverse rotation of the rotary shaft 314 and the blade 303. By this means, the same product (processing target) can be supplied to each user desiring clockwise and counterclockwise rotation; i.e., general applicability can be improved.

Next, referring to FIGS. 11 through 18, the configuration of centrifugal projector 301 will be explained more specifically. The centrifugal projector 301 comprises a control cage 321 and a distributor 322. In addition, the centrifugal projector 301 comprises a main unit case 320, hub unit 323, hub 318, liner 326, lid 327, center plate 328, front cover 329, bracket 330, seal 331, hopper 332, hopper hold down 333, and the like.

The control cage 321 has the function of controlling the projection direction and distribution shape of the projection material. The side plates 311 which constitute the side plate unit 310 have a donut-shaped (ring-shaped) cross section. The control cage 321 is disposed and fixed on the inside of the side plates 311 (inside the inside diameter of the ring-shape). The opening window 321*a* is placed on the control cage 321. Projection material is released toward the blades from this opening window 321*a*.

The bracket 330 functions as a supplementary bracket for supplementing the control cage 321. That is, on the opposite side to its rotary shaft (the hopper 332 side), the control cage 321 has an insertion opening portion 321*b* into which the distributor 322 can be inserted from the opposite side (the hopper 332) to that rotary shaft. Also, on its rotary shaft side the control cage 321 has a cover portion 321*c* for covering the outside part on the rotary shaft side and in the radial direction of the distributor 322. Note that an opening 321*d* is provided on the inside of the cover portion 321*c*, large enough to enable the attachment of a bolt 322*c* for fixing the distributor 322 to the center plate 328 and hub 318. After the distributor 322 is attached, by fixing the bracket 330, along with the hopper 332, to the control cage 321 side, the gap between the control cage 321 and the hopper 332 can be blocked to prevent projection material 302 from being released to the outside from this gap.

As discussed above, the control cage 321 and bracket 330 can be inserted from the hopper 332 side (the opposite side to the rotary shaft 314) when the distributor 322 is disposed inside the control cage 321. By so doing, a cover portion 321*c* covering the outside part on the rotary shaft side and in the radial direction of the distributor 322 can be placed on the control cage 321. This cover portion 321*c* enables the gap between the distributor 322 and the control cage 321 on the rotary shaft side to be reduced, which allows leakage of projection material from this gap to be minimized, and projection material projection efficiency to be improved. The control cage 321 and bracket 330 greatly reduce work time when changing or maintaining the distributor 322.

The distributor 322 accelerates projection material supplied from the hopper 332 while stirring it, then supplies it to the blades 303 through the opening window (opening portion) 321*a* in the control cage 321. Openings are placed, for example, at essentially equal spacing in the circumferential direction on the distributor 322. The distributor 322 is rotatable inside the control cage 321.

Inside the distributor 322, an essentially triangular pyramid projection portion 322*a* forming a hole portion 322*b* for the attaching bolt 322*c* is formed on the interior of the distributor 322. A key channel is formed in the rotary shaft 314 and hub 318, which are linked so that they can rotate together using a key, not shown. A bolt (connecting member) 322*d* is connected to the center plate 328 and the hub 318. The bolt (connecting member) 322*c* connects the rotary shaft 314 and the distributor 322, gripping the center plate 328. The hub 318 has the function of transferring rotary force transferred from the rotary shaft 314 to the side plate unit 310 and the blades 303. The center plate 328 is a plate member with the function of blocking the opening on the rotary shaft side of the side plate unit 310, preventing leakage of projection material. The positional relationship in the radial direction is that the control cage 321 is disposed on the inside of the side plate unit 310, and the distributor 322 is disposed on the inside of the control cage 321. The presence of a member for transferring rotational force as described above results in the blades 303, side plate unit 310, hub 318, center plate 328, and distributor 322 being rotationally driven by the rotary shaft 314.

The hub unit 323 has a rotary shaft 314. This rotary shaft 314 is held by two bearings 325. A pulley for belt transferring drive force from a motor and a hub 318 for transferring to the side plate unit 310 are attached to the rotary shaft 314. The hub 318 has the function of connecting the rotary shaft 314 and the side plates 311 (side plate unit 310).

The side plate unit 310 allows for the attachment of blades 303, and is rotated together with the blades 303. Blades 303 rotate while being attached to the side plate unit 310, thereby projecting the projection material (shot). As described above, the centrifugal projector 301 has blades 303 with a concentrating function (the function of concentrating the projection material 302), side plates 311 to/from which blades 303 can be attached and removed, control cage 321, and distributor 322, so that a projection pattern can be concentrated, and projection efficiency over a narrow projection range can be improved. Using the centrifugal projector 301, projection material is concentrated on blades 303 with a concentrating function, and the concentrated projection material is released. At this point the projection material concentrated by the first part 303*b* is released from the second part 303*c*, which has a shot accelerating function, thereby improving projection efficiency is improved.

The purpose of the main unit case 320 is to assemble each constituent part. The liner 326 protects the main unit case 320 from projection material. A side liner 326*a* and a top liner 326*b* are used in the liner 326. The lid 327 opens and closes the upper opening 320*a* on the main unit case. The center plate 328 functions to prevent blades 303 from dropping and to protect the shaft end portion of the rotary shaft 314. The front cover 329 can be removed for maintenance.

The interior of the bracket 330 has a tapered opening, and projection material (shot) supplied from the hopper 332 is supplied into the distributor 322.

The seal 331 prevents projection material from leaking out from the gap between the hopper 332 and the bracket 330. The hopper 332 supplies projection material into the centrifugal projector 301. The hopper hold down 333 fixes the centrifugal projector 301 main body to the hopper 332. An abrasion-resistant casting may be used for the hopper 332, in which case wear of the interior surface caused by projection material can be reduced, along with the frequency of replacements. It is permissible to use a material with lower abrasion characteristics than abrasion-resistant castings, but to prevent degradation of the flow of projection material due to abrasion of the inside surface requires replacement of parts at the appropriate timing.

Next the centrifugal projector attaching operation will be explained. The procedure for removal is the reverse of the above. The hub unit 323 is fixed to the main unit case 320 with a bolt or the like. To prevent abrasion by the projection material, a liner 326 is attached around the circumference of the rotary shaft 314 on the input surface of the main unit case.

The hub 318 is inserted into the rotary shaft 314 of the hub unit 323. The side plates 311 are fixed to the hub 318 from the inside surface of the centrifugal projector 301 by the bolt 315. Here the pair of side plates 311, separated by a certain distance, are fixed by the connecting member 312. That is, with the pair of side plates 311 connected by the connecting member 312, the side plate unit 310 is fixed to the hub 318.

The blades 303 are inserted from the inside toward the outside of the guide channel portion 313 on the pair of side plates 311, and are fixed by the center plate 328. Since centrifugal force acts in outward direction, a constitution in which blades are not fixed by the center plate 328 is also acceptable. When so doing, the locking portion 303*j* of the blades 303 locks to the inside part 313*d* of the guide channel portion 313, so the position of the blades 303 is appropriately placed.

The front cover 329 is fixed to the main unit case 320 with a bolt or the like. The center plate 328 is fixed by the bolt 315 to the hub 318, holding the inside diameter part of the blades 303 on its outer circumferential portion. After the control cage 321 is inserted into the pair of side plates 311, the distributor 322 is inserted therein, and the distributor 322 is fixed to the rotary shaft 314 by the bolt 322*c*.

On the control cage 321, the position of the opening window 321*a* is adjusted so projection material can be projected in the appropriate direction; the bracket 330, seal 331, and hopper 332 are attached in that order, and the control cage 321 is fixed while being held down by the hopper hold down 333.

The plurality of blades 303 are attached to the pair of side plates 311, separated by a gap, on the outside of the control cage 321. The distributor 322 is placed on the inside of the control cage 321, separated by a gap. The blades 303 and side plates 311, and the distributor 322, can be rotated about the same rotational center O1. The first part 303*b* of the blades 303 can also function as shot receiving portions. The second part 303*c* thereof also functions as a shot acceleration portion.

Next it will be explained a projection method using a centrifugal projector 301, and the motion of projection material projected by the centrifugal projector 301, used in the above-described embodiment of the present invention. The projection method using the centrifugal projector 301 has a step for scattered shot release from the control cage 321, a step for concentrating shot on the blades 303, and a step for releasing shot from the blades 303. That is, in the scatter release step, projection material is scatter-released from the opening window 321*a* on the control cage 321 toward the blades 303. In the concentrating step, the scatter-released projection material is concentrated on the blades 303. In the release step the projection material concentrated on the blades is released from the blades 303.

"Scatter release" here means that projection material is spread apart, scattered, and released. This means projection material is not released as an aggregated group, but a plurality of pieces is released in a spread-apart manner. "Concentration of projection material" refers to raising the density of the plurality of pieces of projection material released in a spread-apart manner onto the blades 303. "Release from the blades 303" refers to the release from the increased density projection material group from the blades 303 to the outside of the centrifugal projector 301. The blades 303 have the function of accelerating projection material received from the control cage by centrifugal force.

The motion of projection material together with the operation of the centrifugal projector 301 parts will be explained. First, the distributor 322, blades 303, side plate unit 310, and so forth are rotated. Next, projection material 302 is supplied into the distributor 322. The supplied projection material 302 is then supplied by centrifugal force from the opening in the rated distributor 322 into the gap between the control cage 321 and the distributor 322. The supplied projection material 302 moves through this gap in the direction of rotation. The projection material 302 moving through the gap flies outward from the opening window 321*a* in the control cage 321. The projection material 302 flying out from the opening window 321*a* is accelerated and concentrated by the first part 303*b* functioning as shot receiving portion; it is then further accelerated by the second part 303*c* functioning as shot accelerating portion, and is projected by centrifugal force from the outside of the blades 303.

Here it will be explained the advantages of the blades 303 in the centrifugal projector 301 used in the above-described embodiment of the present invention. In the conventional blades we compare with the above blades, the first part is not inclined with respect to a plane P1, and no second part is provided. That is, conventional blades have a projection surface with an essentially flat surface (the plane P1 shown in FIG. 15A), and the normal line and rotary shaft are included in this surface. With conventional blades, projection material leaving the opening window in the control cage at different times is projected from the blades with that time difference intact. This results in a broad projection pattern.

In contrast, the blades 303 on the above-described centrifugal projector 301 have the following advantages because the first part 303*b* is inclined rearwardly relative to the plane P1. These advantages will be explained along with the behavior of the projection material 302 using FIGS. 19A-19G. In FIGS. 19A-19G, in order to explain the behavior thereof in an easily understood manner. A part of the projection material 302 released in great volume is selected for the projection material 302*a*-302*c*, (the same is true of the projection material 392*a*-392*c* shown in FIGS. 19H-19N). In the rearwardly inclined blades 303 described above, the last projection material 302*c* to have left the opening window 321*a* first lands on the blades 303, then advances to the outer circumference of the blade as it is being accelerated. When projection material 302*b* which has left the opening window 321*a* midway between the end and start lands on the blades 303, the projection material 302*c* which first landed on the blades 303 is present in close proximity to it. These final and midway projection materials 302*c*, 302*b* are accelerated, so when projection material 302*a* which has left the opening window 321*a* at the beginning lands on the blades, these final and midway projection materials 302*c*, 302*b* are present in close proximity to it. Hence when the above-described blades 303 are used, the projection pattern of the projection material supplied at different times from the opening window 321*a* on the control cage 321 can be narrowed by projection from the blade tips with essentially no time difference.

For comparison with the rearwardly inclined blade explained in the above-described FIGS. 19A-19G we explain, referring to FIGS. 19H-19N, the behavior of the projection material 392 when blades 393 (comparative example) are inclined forward relative to the plane P1, opposite the direction of the blades 303. In the forward-inclined blades 393, the dispersion area for supplied projection material, which connects together the projection material 392*a* which first left from the opening window with the projection material 392*c* which last left the opening window, is essentially parallel to the blades 393. The projection material 392*a* which first left from the opening window, the projection material 392*b* which left midway between the beginning and end, and the projection material 392*c* which last left the opening window therefore all land on the forward-inclined blades 393 at essentially the same time, and the projection pattern widens by the amount of time during which the projection material 392*b* moves over the forward-inclined blades 393 to the position of the projection material 392*a*.

The constitution and advantages of the above-described first part 303*b* of the blades 303 were discovered by the present inventors by careful examination of the behavior of projection material supplied to blades, and of repeated simulations and experimentation. The present inventors also carefully examined the behavior of blades inclined forward relative to the plane P1, and comparing these elements determined the constitution described above. In addition, with respect to the advantages of the second part 303*c* described next, the appropriate range of the inclined angle θ1, and the above-described number of blades 303, the inventors succeeded through repeated simulations and experiments in finding an advantageous and feasible solution and were able to make something which can be mass produced and which is feasible in light of the fact that blades are consumable parts.

Next the advantages of the second part 303*c* will be explained in further detail. As described above, when the advantages of the first part 303*b* are considered, the blade 303 can be made practical using only rearward-inclined surfaces for concentrating the projection pattern. However, projection speed relative to rpm declines to the degree the blades are inclined rearwardly, therefore to increase projection speed requires raising the rpm. Increasing the rpm causes problems such as a rise in power consumption or a rise in noise when projection material is not being projected. By measures such as placement of a bent portion on the outside of the first part 303*b* serving as a shot receiving portion, it was able to concentrate the projection pattern without changing projection power efficiency by adopting a constitution using blades 303 (accurately stated, the blades 303 explained in FIGS. 13A-13F and 14A-14D) wherein the second part 303*c*, which in substance performs the blade projection, is inclined further forward than the first part 303*b*, which is the receiving portion. This enabled the projection speed relative to rpm to be increased using the second part 303*c* of the blades 303.

The inclined angle θ1 on the first part 303*b* of the blades 303 will be explained in further detail. As described above, 30°-50° is favorable for the rearwardly inclined angle of for the first part 303*b*, i.e., the inclined angle θ1 relative to plane P1. As described above, on the blades 303 the projection pattern is concentrated by gathering continuously supplied projection material in the first part 303*b*, but if the angle is less than 30°, the time difference in riding on the blades is shortened, and the degree of distribution concentration is reduced. Above 50°, the time difference becomes too large, and projection material which has landed on the blades close to the blade stem passes projection material received at the tip portion of the blades and is projected first, reducing effectiveness. Since the length of the first part 303*b* increases as the blades are inclined rearwardly, blades become heavier, increasing parts cost, reducing workability, and so forth. An appropriate range of angles is determined based on the reasons above.

It happens that the above-described projection surface 303*a* is also the surface on which the earlier explained projection material 302 moves. The projection back surface 303*q* is also opposite the surface on which the projection material 302 moves. The blade projection portion 303*g* may be said to be at least in part sandwiched between this projection surface 303*a* and the projection back surface 303*q*. The attachment portions 303*h* are members for attaching and fixing the blades 303 to the pair of side plates 311. The shape of the attachment portions 303*h* and the guide channel portion 313 is not limited to that described above, but should be constituted so that the blades 303 are mechanically attachable and detachable from the side plate unit 310. It is desirable for the combination of the side plate unit 310 and blades 303 to be fixed by centrifugal force as described above, for example.

In the centrifugal projector 301 and blades 303 used for same, constituted as described above, the projection material projection pattern can be concentrated, and projection efficiency can be increased in a narrow projection range. That is, the projection pattern is concentrated, therefore the number of shot pieces not hitting the product can be reduced and projection efficiency improved when the processing target is small.

Thus by careful investigation of the overall motion of projection material supplied to each blade, it has been possible to identify for the first time the optimal constitution for the centrifugal projector 301 and blades 303. Previous efforts sought to study the motion of projection material one ball at a time to increase acceleration characteristics. This constitution of the centrifugal projector enables concentration of the motion of all projection material to concentrate the projection pattern. High efficiency projection is thus enabled.

In addition, the above-described side plate unit 310 and centrifugal projector 301 in which it is used can concentrate the projection material projection pattern so that projection efficiency relative to a narrow projection range can be increased, and the following effects obtained. That is, blades 303 with the above-described types of effect can be easily and securely attached and replaced.

Note that the blades used in a centrifugal projector 301 used in an embodiment of the invention are not limited to the blades 303 shown in the above-described FIGS. 13A-13F and 14A-14D. It is sufficient that they be constituted to have at least one of the above-described effects. Specifically, the blades 307 shown in FIGS. 20A-20F and 21A-21D may also be used as blades for the centrifugal projector 301. Note that with respect to the above-described blades 303, the blades 307 have essentially the same constitution and effect as the blades 303, other than not having the raised portion 303*r* and raised portion 303*r*. Parts with the same constitution, function, and effect are identified with the same names and similar reference numerals (reference numerals following "303" and "307" are shared in common), and a detailed explanation thereof is omitted.

As shown in FIGS. 20A-20F and 21A-21D, the projection surface 307*a* on the blades 307 has a first part 307*b*, being the inside part of the projection surface 307*a* in the radial direction, and a second part 307*c*, being the outside part of the projection surface 307*a*, positioned on the outside of the first part 307*b* in the radial direction. The blade 307 second part 307*c* is disposed as an integral part of the first part 307*b*, mediated by a bent or curved portion relative to the first part 307*b*. Note that in the example explained here, mediation is through a curved portion 307*d*.

In the same way as the above-described first part 303*b*, the first part 307*b* of the blades 307 is formed at a pitch so that its radial outer side is positioned further behind its inner side in the rotational direction R1. In the same way as the above-described second part 303*c*, the second part 307*c* is formed so that it is positioned further to the front in the rotational direction than an imaginary line extending the first part 307*b* outward.

The blades 307, like the blades 303 described above, have a blade projection portion 307*g* with a projection surface 307*a* for projecting projection material, and a pair of attachment portions 307*h* positioned on the two edge portions of this blade projection portion 307*g*. In the attachment portions 307*h*, at least the outside part 307*i* thereof is formed in a straight shape. The blade projection portion 307*g* has a curved or bent shape, but the majority of the outside part of the attachment portions 307*h* (the majority of the inside part described below) is considered as straight part 307*h*3.

The blades 307 attachment portions 307*h* have a locking portion 307*j* on the inside part thereof. The locking portion 307*j* is formed to protrude from the above-described straight shape. In addition, plurality of contacting portions 307*k* is disposed on the outside of the pair of attachment portions 307*h*. The contacting portions 307*k* are formed to project from the outside surface 307*m* of the attachment portions 307*h*. Note also that on the blades 307, the entire outer surface of the locking portion 307*j* is a contacting portion 307*k*. The blade projection portion 307*g* and attachment portions 307*h* are formed so that the spacing L9 of the inside surfaces 303*h*1 opposing the pair of attachment portions 303*h* becomes gradually smaller toward the outside with respect to the inside (center direction) in the radial direction. The relationship between the outer surface 307*h*2 of attachment portions 307*h*, both edge portions 307*g*1 on the blade projection portion 307*g*, and so forth is also as explained above for the blades 303.

Also, as was the case for the above-described blades 303, the second part 307*c* of the blades 307 is formed so that the imaginary line connecting the rotational center of the blades 307 and a point close to the outside edge portion of the second part 307*c* matches the normal line, therefore the above-described projection material acceleration capability can be demonstrated. Here the imaginary line (same as the imaginary line L2 shown in FIGS. 15A-15C using blades 303) connecting the rotational center of the blades 307 and the outer end portion 307*n* of the second part 307*c* is formed to match the normal line.

The inner end portion 307*p* of the blade projection portion 307*g* on the blades 307 is formed in an inwardly tapered shape, as described above relative to the blades 303 and, by expanding the distance between the inner end portions 307*p* between each of the blades 307, can function as guide portions for increasing the amount of projection material guided between the rotating blades 307.

As described above, the blades 307 have essentially the same constitution as the blades 303, except for not having projecting portions and associated structures on the projection back surface 307*q*. The projection back surface 307*q* is formed in a curved shape (a curved shape without a bent portion) except for the taper-forming portion 307*u*. The taper-forming portion 307*u* forms the above-described first part 307*b* and the above-described tapered end portion 307*p*. Note that the taper-forming portion 307*u* here was formed in a planar shape, but it may also be formed in a curved shape, i.e., as a portion of the curved surface formed in the projection back surface 307*q*.

Using the centrifugal projector 301 and blades 307 used for same constituted as described above, the projection material projection pattern can be concentrated, and projection efficiency increased with respect to a narrow projection range. Parts of the blades 307 with the same constitution as the blades 303 provide the effects obtained from that constitution.

The same effects of the above-described blades 303, 307 themselves can be demonstrated even if, for example, the side plate unit, distributor, control cage, or other parts differ in constitution from what was described above. For example, for side plates used for both these blades 303 and 307, the side plate is not limited to the above-described pair of side plates, but may also be, for example, a single side plate.

Next, referring to FIGS. 22A-22N, a variant example of a control cage used in a centrifugal projector 301 will be explained. That is, a control cage will be explained, used simultaneously with the above-described blades 303, 307, from which a synergistic effect is obtained. The above-described control cage 321, as shown for example in FIG. 22A, has a rectangular opening window 321*a*. The control cage used in the centrifugal projector 301 is not limited to the above.

The control cage used in the centrifugal projector 301 may have two or more opening windows selected from among square or triangular opening windows. In addition to having two or more opening windows selected from among square or triangular opening windows, it is also acceptable to have a single opening window formed as a single piece by partially overlapping all or a part of these opening windows. Examples mentioned here of squares include rectangles (rectangles or regular squares) or other parallelogram, etc. Specifically, the control cage 341 shown in FIG. 22B may be used as the control cage for the centrifugal projector 301.

The control cage 341 shown in FIG. 22B has two square opening windows 341*a* and 341*b*. Except for the constitution of the opening window, the control cage 341 comprises the same constitution as the above-described control cage 321, so a detailed explanation thereof is here omitted.

Here the advantages of FIG. 22B, which is the example of a control cage from which a synergistic effect is obtained using the blades 303 and 307 simultaneously, will be explained. In the step whereby projection material from the above-described control cage is scatter-released, projection material is supplied in a phase-differentiated manner from the opening windows 341*a*, 341*b*. This enables the composition of a projection pattern; uniform processing is applied to the processing targets, and the total amount of projection required for processing can be reduced.

Details of phase differentiation in the control cage opening window are now explained. Projection material is continuously released from the control cage opening window. Here, as shown in FIG. 22B, the opening windows 341*a* and 341*b* are provided on the control gate 341; when positioned in the circumferential direction, an offset occurs in each of the respective projections. That is, the offset positioning of the opening windows 341*a* and 341*b* results in a positional offset between the projection material which leaves the first opening window 341*a* and the projection material which leaves the second opening window 341*b*. That projection offset becomes a phase difference, which results in the composition of a projection pattern. That is, in the shot scatter-release step of the centrifugal projection method when the control cage 341 is used, a phase difference (projection offset) in the scatter-released projection material is caused to occur by releasing projection material from two opening windows.

The composition of the pattern created by this control cage 341 can also be performed by blades other than the blades 303 or 307. However, if the original projection pattern is broad, the result will be merely a broad projection, even if the composition is offset therefrom, and no advantage will be gained. In general, a square opening window is used to narrow the original distribution (the distribution of the respective opening portions). Also, the supplying of projection material with a phase differential from the control cage can itself also be achieved by changing the shape of the opening window. For example, the shape of the control cage opening window may be made rectangular (rectangular or square). By so doing, the timing at which projection material is supplied from the control cage to the blades is simultaneous in the blade width direction. On the other hand, a method is also conceivable in which, by using a triangular or other shape for the opening window, the timing at which projection materials are supplied to the blades can be offset across the blade width direction. The present inventors have discovered that a parallelogram is preferable when processing a flat panel. As described above, the control cage 341 has good compatibility with the blades 303 and 307, which are able to concentrate and narrow the projection pattern. That is, by composing a projection pattern concentrated by the blades 303, 307, the control cage 341 is able to increase the amount of projection within the total range of the processing target.

In other words, by composing a pattern using the above-described blades 303, 307 and the control cage 341, etc., a projection pattern fitting the product, which is the processing target, can be formed. Specifically, after gathering projection material on the blades to concentrate the projection pattern, any desired projection pattern may be set using a technology for composing distributions, such as the control cage 341, and the fraction of projection material resulting in processing variability or not hitting the product can be reduced.

A centrifugal projector 301 using a control cage 341 raises projection efficiency and achieves a reduction in the total amount of projection material required for product processing. That is, if there is projected projection material which does not hit the product, or a larger fraction of projection material hits the product than required, then even if the projection material acceleration efficiency improves, there will be an increase in the total projection amount, and efficiency in performing the targeted processing cannot be said to rise very much. Depending on the product, there were some cases in which only about ⅕ of the projected projection material contributed to processing the product. A centrifugal projector 301 with these improved blades 303, 307 and control cage 341 has a dramatic effect.

Figure 23:
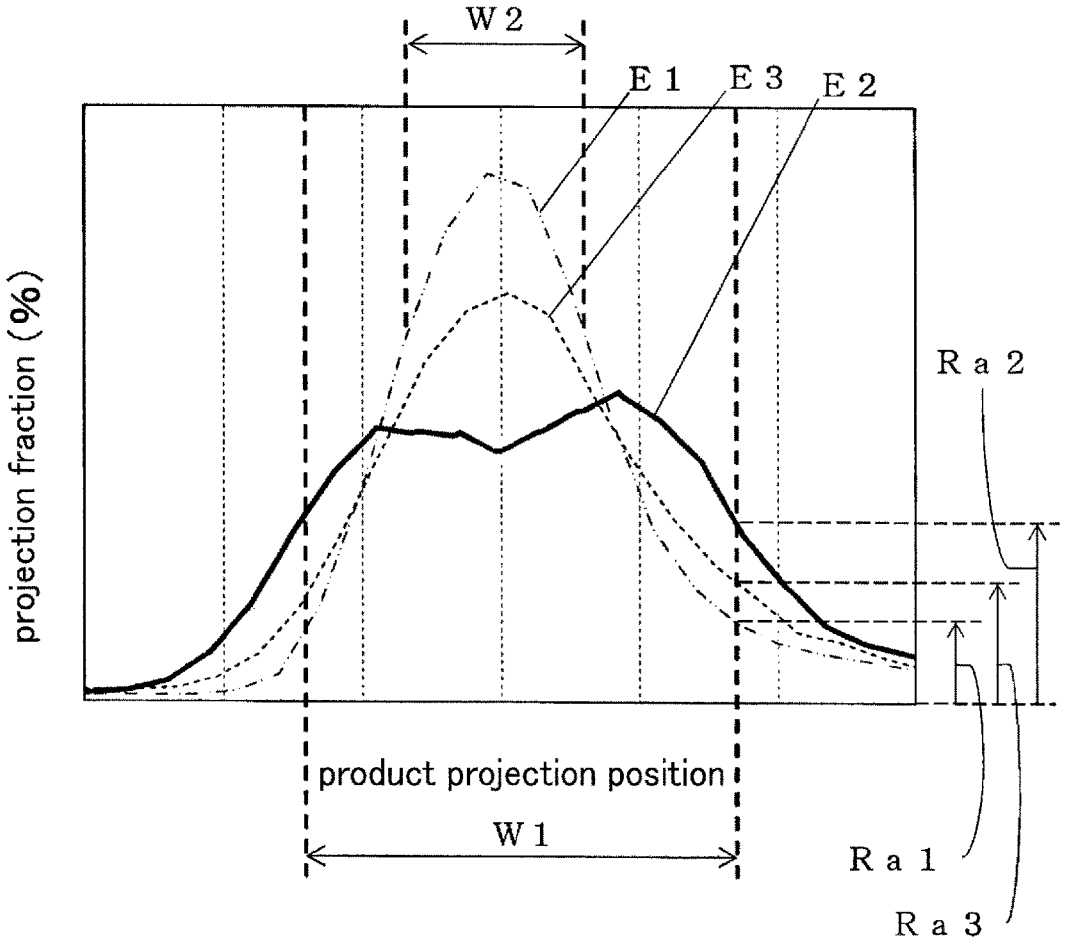
FIG. 23 is a diagram showing the distribution of projection ratios in centrifugal projectors according to test examples 1 and 2, and a comparative example of the present invention.

Here, referring to FIG. 23, the advantages of the blades 303, 307 and the control cage 341 using test examples will be explained. FIG. 23 is a diagram showing what percentage of the total projected projection material is projected onto which part of the product (processing target). FIG. 23 may also be said to show the projection pattern relative to a product. The horizontal axis shows the product projection position. The vertical axis shows the projection fraction and percentage of total.

In FIG. 23, E3 shows the results of a comparative example. In the comparative example, results are shown using the above-described conventional blades, i.e., blades with a projection surface having an essentially flat surface (the surface on plane P1), and a control cage with a single opening window. E1 shows the results of test example 1. Test example 1 is the result obtained using the blades 303 shown in FIGS. 20A-20F and 21A-21D and a control cage (e.g., FIG. 22A) having a single opening window. E2 shows the results of test example 2. Test example 2 is a result obtained using the blades 303 and a control cage (e.g., FIG. 22B) having two opening windows. Note also that E1, E2, and E3 show test results.

In FIG. 23, W1 shows the product (processing target) range; i.e., the projection range on the product. Ra3 shows the minimum projection fraction within the range of a processing target in a comparative example. Ra1 shows the minimum projection fraction within the range of a processing target in test example 1. Ra2 shows the minimum projection fraction within the range of a processed part in test example 2.

In FIG. 23, the maximum value of the projection fraction in the test example 1 projection pattern is high with respect to the projection pattern in the comparative example, while on the other hand the fraction is low in other parts, so it can be confirmed that the projection is concentrated.

When the rejection amount is equal, the processing time for the processed part lengthens in inverse proportion to the lowest projection fraction. When the product range is W1, Ra3>Ra1, therefore the processing time is shorter for the comparative example than for the test example 1. When composing a projection pattern such as that in example 2, there are two peaks within W1, and adjustment can be made to achieve an overall flat projection pattern. In the test example 2 case, Ra2>Ra3, and processing time is much shorter in test example 2 than in the comparative example. Note that in the comparative example, because the distribution is broad, overall efficiency is low even if there are two opening windows; i.e., shot not hitting the processed part increases and processing time increases further. This means that for processed parts such as those shown by W2, for example, projection efficiency is highest and processing time is shortened in test example 1.

In the W1 product case, as described above, test example 2 is most superior. Thus projection of the required amount of projection material onto the necessary parts means that processing time can be shortened and projection amounts can be reduced. Electrical power used for projection can thus be reduced, and furthermore power used to circulate shot can be reduced by reducing the amount of projection material in circulation; projection material abrasion can also be reduced. In addition, abrasion of projection material and of the liner caused by impact on the liner inside the projection chamber (a projection chamber in a surface treatment apparatus using a centrifugal projector 301) by projection material not hitting the product can also be reduced.

As described above, there is extremely good compatibility between a control cage with plurality of opening windows and the blades 303 and 307 which enable concentration of the above-described projection pattern. Also, with a control cage enabling the composition of such a projection pattern, and blades 303 and 307, the projection pattern of projection material can be concentrated and adjustments made to achieve a projection pattern appropriate to the processed part, thereby increasing projection efficiency. That is, processing variability and projection material not hitting the processing targets can be reduced, as can the total amount of projected projection material.

Starting in FIG. 23, the projection amounts required for each product are determined according to set processing conditions. Ideally, if shot is uniformly projected onto the processed surface, one may say that the quality of the processed surface is also uniform and that no wasted projection occurs. In reality, however, because the projection pattern is not uniform, projection density differed between locations on the product, and processing variability occurred. Also, it could occurred that the large number of shot did not hit the product, and depending on the product and apparatus, less than 20% of the projected shot contributed to the quality of product processing. In response to this, projection efficiency can be raised using a centrifugal projector 301 comprising the above-described blades 303, 307 and control cage 341, and the centrifugal projection method using same.

Next, referring to FIGS. 22A-22N, it will be explained variant examples of the control cage used in a centrifugal projector 301 used in an embodiment of the present invention, as well as the operational effects of changes to the control cage. The control cage used simultaneously with the above-described blades 303, 307, from which a synergistic effect is obtained may also be the control cage 342, 343, 344, or 345 according to FIGS. 22C-22F, in addition to the above described FIGS. 22A and 22B. Below we explain these control cages 342-345, but except for the constitution of the opening window, these comprise the same constitution as the above-described control cage 321, so a detailed explanation thereof is here omitted.

The control cage 342 shown in FIG. 22C has a single opening window 342*x*, integrated as a single piece by the partial overlapping of parts of two rectangular opening windows. The opening window 342*x* has rectangular parts 342*a*, 342*b* constituting a window. For example, the sizes of the rectangular parts 342*a*, 342*b* are assumed to be the same as the size of the opening windows 341*a*, 341*b*. The control cage 343 shown in FIG. 22D has a parallelogram-shaped opening window 343*a*.

The control cage 344 shown in FIG. 22E has rectangular and parallelogram-shaped opening windows and has three such opening windows, and has a single opening window 344*x* which is integrated into a single piece by the partial overlap of a portion of these opening windows. The opening window 344*x* has a rectangular part 344*a*, a parallelogram-shaped part 344*b*, and a rectangular part 344*c*, forming a window, and is integrated as a single piece, positioned in this order. The control cage 345 shown in FIG. 22F has five rectangular opening windows, and has an opening window 345*x*, integrally formed as a single piece by the partial overlap of a portion of these opening windows. The opening window 345*x* has a rectangular part 345*a*, a rectangular part 345*e*, and narrow width rectangular parts 345*b*, 345*c*, and 345*d* positioned between the above, together constituting a window. The sizes of the rectangular parts 345*a*, 345*e* are, for example, essentially the same as the sizes of the rectangular parts 344*a*, 344*c*. The positions and sizes of the area combining the rectangular parts 345*b*, 345*c*, and 345*d* are, for example, essentially the same as the positions and sizes of the parallelogram-shaped part 344*b*.

Next, referring to FIGS. 22A-22N, it will be explained variant examples of the control cage used in a centrifugal projector 301 used in an embodiment of the present invention, as well as operational effects of changing the control cage. Note that FIGS. 22A-22F are side elevations of a control cage with a cylindrical shape (diagrams show an opening window placed in the side surface); FIGS. 22G-22N show the case when the blades, etc., rotate in the direction of the arrow in FIGS. 22A-22N when the control cage shown in FIGS. 22A-22F is viewed from the left side (the hopper side), i.e., when blades passing through the window on each control cage rotate from down to up on the FIGS. 22A-22N paper surface.

First, the area through which projection material passes when the FIG. 22A control cage 321 is used is shown by B0 in FIG. 22G; the area on the processed surface where projection material hits is shown by BA0 in FIG. 22H, and the projection pattern (distribution) is shown by BL0 in FIG. 22G. Note that "area on the processed surface where projection material hits" means the "area where projection material hits" assuming the processed surface is on a plane essentially perpendicular to the direction in which the projection material is projected. The opening window 321*a* shown in FIG. 22A is one in general use.

The area through which projection material passes when the FIG. 22D control cage 343 is used is shown by B3 in FIG. 22K; the area on the processed surface where projection material hits is shown by BA3 in FIG. 22L, and the projection pattern (distribution) is shown by BL3 in FIG. 22K. The opening window 343 shown in FIG. 22D is a parallelogram; since the timing at which projection material is supplied from the control cage 343 to the blades is offset in the width direction of the blades, the projection pattern is softened. The processing target processing time lengthens in inverse proportion to the lowest projection fraction, therefore depending on the shape of the product this may be more advantageous than the case of FIG. 22A.

In other words, the control cage 343 has a parallelogram-shaped opening window 343*a*; in the parallelogram of this opening window 343*a*, because the position in the circumferential direction is offset from the position in the direction parallel to the rotary shaft of the mutually opposing sides formed in the circumferential direction, the positional relationship seen on the side of the control cage 343 (the positional relationship shown in FIG. 22D) is one of diagonal alignment, therefore an appropriate projection pattern is obtained. This constitution, by its use together with the concentrating performance of the blades 303, 307, has the effect of increasing projection efficiency relative to the product. Additionally, by applying the same thought as applied when providing this parallelogram, it is also acceptable to provide a triangular opening window, or to provide an opening window combining a triangular opening window and a square opening window, or an opening window integrating parts thereof into a single entity.

The areas through which projection material passes when the FIGS. 22B and 22C control cages 341, 342 are used are shown by B1*a*, B1*b* in FIG. 22I; the areas hit by the projection material on the processed surface are shown by BA1*a*, BA1*x*, and BA1*b* in FIG. 22J, and the projection pattern (distribution) is shown by BL1*x* in FIG. 22I. Area B1*a*, projection pattern BL1*a*, and area BA1*a* correspond to the opening window 341*a* (rectangular part 342*a*). Area B1*b*, projection pattern BL1*b*, and area BA1*b* correspond to the opening window 341*b* (rectangular part 342*b*). The overlapping part of areas B1*a*, B1*b* is area B1*x*. The overlapping part of areas BA1*a*, BA1*b* is area BA1*x*. The synthesis (adding together) of projection pattern BL1*a* and BL1*b* is the projection pattern BL1*x*, which may be described as the projection pattern when these control cage 341 and 342 are used.

The control cages 341, 342 have two or more opening windows, or have a single opening window integrating two or more opening windows, therefore the projection pattern can be adjusted to a desired pattern by composing the projection pattern. The processing target processing time lengthens in inverse proportion to the lowest projection fraction, therefore depending on the shape of the product this may be more advantageous than the cases of FIG. 22A and FIG. 22D.

In other words, the control cages 341, 342 either have two rectangular opening windows 341*a*, 341*b*, or have two rectangular opening windows (rectangular parts 342*a*, 342*b*) and have a single opening window 342*x* integrating a partial overlap of those windows. Because the position in the circumferential direction and the position in the direction parallel to the rotary shaft are offset in the two rectangles (opening windows 341*a*, 341*b*) (rectangular parts 342*a*, 342*b*), the positional relationship (positional relationship in FIGS. 22B and 22C) seen in the side surfaces of the control cages 341, 342 is one of diagonal alignment, therefore an appropriate projection pattern (desired projection pattern) is obtained. This constitution, by its use together with the concentrating performance of the blades 303, 307, has the effect of increasing projection efficiency relative to the product.

The areas through which projection material passes when the FIGS. 22E-22F control cages 344, 345 are used are shown by B4*a*, B4*b*, B4*x*, and B4*c* in FIG. 22M; the areas hit by the projection material on the processed surface are shown by BA4*a*, BA4*x*, and BA4*c* in FIG. 22N, and the projection pattern (distribution) is shown by BL4*x* in FIG. 22M. Area B4*a*, projection pattern BL4*a*, and area BA4*a* correspond to opening window 344*a* (rectangular part 345*a*). Area B4*c*, projection pattern BL4*c*, and area BA4*c* correspond to opening window 344*c* (rectangular part 345*e*). The overlapping part of areas B4*a*, B4*c* is area B4*x*. The overlapping part of areas BA4*a*, BA4*c* is area BA4*x*. The synthesis (adding together) of projection pattern BL4*a* and BL4*c* is a projection pattern BL4*x*, which may be described as the projection pattern when these control cage 344 and 345 are used.

The control cages 344, 345 have a single opening window integrating three or more opening windows, therefore the projection pattern can be adjusted to a desired pattern by composing the projection pattern. Specifically, the projection pattern BL1*x* described using FIG. 22I forms an M shape; i.e., the projection fraction is slightly less in the part between two peaks. By placement of a parallelogram part 344*b* in the case of FIG. 22E, or placement of plurality of rectangular parts 345*b*, 345*c*, and 345*d* in the case of FIG. 22F, between the rectangular parts 344*a*, 344*c* (rectangular parts 345*a*, 345*e*) corresponding to the opening windows 341*a*, 341*b* (rectangular parts 342*a*, 342*b*) in FIGS. 22B and 22C, the projection fraction of the part between the two peaks can be adjusted upward. The processing time of processing target lengthens in inverse proportion to the lowest projection fraction, therefore depending on the shape of the product this may be more advantageous than the FIG. 22A through FIG. 22D cases. Also, a projection pattern can be obtained in which processing variability is reduced as much as possible.

In other words, the control cage 344 has a single integrated opening window 344*x* in which three squares (parts 344*a*, 344*b*, 344*c*) are partially overlapped. In the positional relationship seen on the side of the control cage 344*x* (positional relationship in FIG. 22E), the opening window 344*x* has a diagonally aligned first rectangular part 344*a* and a second rectangular part 344*c*, and a parallelogram part 344*b* placed between the first rectangular part 344*a* and the second rectangular part 344*c*. The first rectangular part 344*a*, the second rectangular part 344*c* and the parallelogram part 344*b* are respectively offset in positions in the circumferential direction and positions in the direction parallel to the rotary shaft. By this constitution, an appropriate projection pattern (desired projection pattern) is obtained. This constitution, by its use together with the concentrating performance of the blades 303, 307, has the effect of increasing projection efficiency relative to the product.

The control cage 345 has a single integrated opening window 345*x* in which five squares (this will be explained as having parts 345*a* through 345*e*, but the same effect is demonstrated by partially overlapping four or more squares). In the positional relationship seen on the side of the control cage 345 (the positional relationship in FIG. 22F), the opening window 345 has a diagonally aligned first rectangular part (345*a*) and a second rectangular part (345*e*), and a rectangular part group formed of plurality of rectangular parts 345*b*, 345*c*, and 345*d* placed between the first rectangular part (345*a*) and second rectangular part (345*e*); this first rectangular part (345*a*), second rectangular part (345*e*), and rectangular part group formed of plurality of rectangular parts 345*b*, 345*c*, and 345*d* are respectively offset in their rotational direction positions and their positions in the direction parallel to the rotary shaft. In addition, the rectangular part group formed of plurality of rectangular parts 345*b*, 345*c*, and 345*d* are also offset in their rotational direction positions and their positions in the direction parallel to the rotary shaft, and are formed to line up diagonally when viewed on the side of the control cage 345. The rectangular parts 345*b*, 345*c*, and 345*d* which comprise this rectangular part group are formed so that their length in the direction parallel to the rotary shaft is smaller than the first rectangular part and the second rectangular part (345*a*, 345*e*). By this constitution, an appropriate projection pattern (desired projection pattern) is obtained. This constitution, by its use together with the concentrating performance of the blades 303, 307, has the effect of increasing projection efficiency relative to the product.

As described above, a control cage having either two or more opening windows, or a having two or more opening windows and having a single opening window integrated by the partial overlap of either the entirety of these opening windows or respective parts thereof, is capable of adjusting the projection pattern. The control cage produces the synergistic effect of blades 303 and 307, which concentrate the projection pattern; in other words it is capable of increasing the projection amount in the overall range of the processing target. It also reduces product processing variability and reduces the fraction of projection material not hitting the product, raising the projection material projection efficiency.

Note that the above embodiments and the aforementioned multiple variant examples may also be combined as appropriate.

What is claimed is:

1. A shot processing apparatus comprising:

a workpiece transport mechanism operable to transport a workpiece in a transport direction; and a projector operable to project shot blast materials onto the workpiece being transported by the workpiece transport mechanism, wherein the workpiece transport mechanism comprises:

a pair of elongated cylindrical rollers extensive in parallel to each other in the transport direction, the pair of rollers being disposed at a distance therebetween that is smaller than the workpiece so that the workpiece can be loaded between the pair of rollers, the pair of rollers being drivable to each rotate in a first rotational direction around its axis extensive in the transport direction to rotate the workpiece loaded therebetween in a second rotational direction opposite to the first rotational direction;

an endless chain drivable to move in the transport direction;

and a transport member attached to the endless chain so as to move in the transport direction along with movement of the endless chain, the transport member being configured to project between the pair of rollers and having a pushing part configured to come in contact with the workpiece loaded between the pair of rollers and push the workpiece, along with movement of the endless chain, in the transport direction slidably on the pair of rollers while the workpiece is rotated by the pair of rollers;

wherein the projector is a centrifugal projector disposed above the pair of rollers and operable to project the shot blast materials onto the workpiece loaded between the pair of rollers and being transported by the transport member in the transport direction, the projector comprising:

a control cage formed in a cylindrical shape and disposed so that its central axis extends in a direction perpendicular to the transport direction, the control cage having a circumferential surface in which a first opening and second opening are formed, the first and second openings being formed staggered in both a circumferential direction and a direction along the central axis, wherein the control cage is configured to receive the shot blast materials inside thereof and push the received shot blast materials out from the first and second openings by means of centrifugal force;

and a blade wheel, wherein the blade wheel includes:

(a) at least one side plate;

(b) plurality of blades attached to the side plate so as to extend radially outwardly with respect to the control cage;

(c) a rotary shaft operable to rotate the at least one side plate and the plurality of blades attached to the at least one side plate;

(d) an introducing part formed between a respective pair of two adjacent blades to introduce the shot blast materials pushed out from the control cage into between the respective pair of two adjacent blades, wherein each blade includes a projection surface configured to project the shot blast materials, and the projection surface is bifurcated along a radial direction into a first part and a second part being radially inward of the first part, the first part of the blade being inclined such that a radially outer side of the first part is more inclined rearwardly in a rotational direction than a radially inner side of the first part, and the second part of the blade being positioned frontwardly in the rotational direction from an imaginary line being extensive along the first part of the blade, and wherein each blade has a blade projection portion on which the projection surface for projecting the projection material is formed, and each blade has a pair of attachment portions being integrally formed, respectively, along longitudinal sides of the blade projection portion, the pair of attachment portions being thicker in the rotational direction than the blade projection portion;

(e) a side plate unit to which the plurality of blades are attached, wherein the side plate unit includes a pair of side plates and a connecting member configured to connect the pair of side plates together;

(f) guide channel portions formed in opposing surfaces of the pair of the side plates of the side plate unit; and (g) side plate guide channel portions formed in the opposing surfaces of the pair of side plates, the side plate guide channel portions being inclined such that a radially outer side of each side plate guide channel portion is positioned rearwardly of a radially inner side thereof in the rotational direction, wherein the side plate unit is attached to the rotary shaft by a bolt, and the side plate guide channel portions each has a recessed portion configured to receive a head of the bolt.

2. The shot processing apparatus of claim 1, wherein the first opening and the second opening each have a rectangular shape two sides of which are parallel to the center axis of the control cage.

3. The shot processing apparatus of claim 1, wherein the first part of the projection surface is formed longer in the radial direction than the second part thereof.

4. The shot processing apparatus of claim 1, wherein the first part and the second part of the projection surface are connected by a curved surface.

* * * * *